US011302262B2

(12) United States Patent
In et al.

(10) Patent No.: US 11,302,262 B2
(45) Date of Patent: Apr. 12, 2022

(54) ORGANIC LIGHT-EMITTING DISPLAY DEVICE

(71) Applicant: Samsung Display Co., Ltd., Yongin-si (KR)

(72) Inventors: Hai-Jung In, Seoul (KR); Won Kyu Kwak, Seongnam-si (KR); Jae-Sic Lee, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/107,677

(22) Filed: Nov. 30, 2020

(65) Prior Publication Data

US 2021/0166635 A1 Jun. 3, 2021

(30) Foreign Application Priority Data

Dec. 2, 2019 (KR) ..... 10-2019-0158107

(51) Int. Cl.
*G09G 3/3275* (2016.01)
*G09G 3/3266* (2016.01)

(52) U.S. Cl.
CPC ..... *G09G 3/3275* (2013.01); *G09G 3/3266* (2013.01); *G09G 2300/0465* (2013.01); *G09G 2310/0278* (2013.01)

(58) Field of Classification Search
CPC ..... G09G 3/3275; G09G 3/3266; G09G 2300/0465; G09G 2310/0278
See application file for complete search history.

(56) References Cited

U.S. PATENT DOCUMENTS 9,165,506 B2 * 10/2015 Gu ..... G09G 3/3208
9,368,562 B2 6/2016 Xu
2004/0160406 A1 * 8/2004 Yamazaki ..... G09G 5/391 345/100

(Continued)

FOREIGN PATENT DOCUMENTS

KR 10-0515351 B1 9/2005
KR 10-0601379 B1 7/2006

(Continued)

*Primary Examiner* — Ibrahim A Khan
(74) *Attorney, Agent, or Firm* — Lewis Roca Rothgerber Christie LLP

(57) ABSTRACT

An organic light-emitting display device includes: a data driver configured to divide one frame into an odd-numbered sub-frame and an even-numbered sub-frame, to divide frame data for implementing the one frame into odd-numbered sub-frame data and even-numbered sub-frame data, to provide the odd-numbered sub-frame data to the data lines in the odd-numbered sub-frame, and to provide the even-numbered sub-frame data to the data lines in the even-numbered sub-frame; an odd-numbered scan driver electrically connected to odd-numbered scan lines to provide an odd-numbered scan signal to the odd-numbered scan lines in the odd-numbered sub-frame; an even-numbered scan driver electrically connected to even-numbered scan lines to provide an even-numbered scan signal to the even-numbered scan lines in the even-numbered sub-frame; an emission driver to provide an emission signal to emission line groups formed by grouping the emission lines by two adjacent emission lines in the odd-numbered sub-frame and the even-numbered sub-frame.

19 Claims, 12 Drawing Sheets

(56) References Cited

U.S. PATENT DOCUMENTS

| | | | | |
|---|---|---|---|---|
| 2008/0284931 | A1* | 11/2008 | Kimura | G09G 3/3607 349/39 |
| 2009/0295782 | A1* | 12/2009 | Lee | G09G 3/3258 345/213 |
| 2012/0212517 | A1* | 8/2012 | Ahn | G09G 3/3266 345/690 |
| 2014/0009456 | A1* | 1/2014 | Kim | G09G 3/3208 345/212 |
| 2015/0002560 | A1* | 1/2015 | Kwon | G09G 3/3266 345/691 |
| 2016/0063961 | A1* | 3/2016 | Pyo | G09G 3/3266 345/213 |
| 2018/0033376 | A1* | 2/2018 | Fu | G09G 3/3225 |
| 2018/0158396 | A1* | 6/2018 | Lee | G09G 3/3266 |
| 2018/0357965 | A1* | 12/2018 | Chung | G09G 3/3266 |

FOREIGN PATENT DOCUMENTS

| | | | |
|---|---|---|---|
| KR | 10-0601380 | B1 | 7/2006 |
| KR | 10-0601382 | B1 | 7/2006 |
| KR | 10-1084182 | B1 | 11/2011 |

* cited by examiner

ORGANIC LIGHT-EMITTING DISPLAY DEVICE

CROSS-REFERENCE TO RELATED APPLICATION

The present application claims priority to and the benefit of Korean Patent Application No. 10-2019-0158107, filed on Dec. 2, 2019 in the Korean Intellectual Property Office (KIPO), the entire content of which is incorporated herein by reference.

BACKGROUND

1. Field

Aspects of some example embodiments relate generally to an organic light-emitting display device.

2. Description of the Related Art

In order to enhance an image quality of an organic light-emitting display device, a resolution of the organic light-emitting display device may be increased. For example, an organic light-emitting display device has a resolution of Full High Definition (FHD), Quad High Definition (QHD), Ultra High Definition (UHD), and the like). In addition, an organic light-emitting display device may operate at a relatively high speed (e.g., at a relatively high driving frequency of 90 Hz, 120 Hz, and the like). That is, because the number of scan lines included in the organic light-emitting display device increases and a frame time for implementing one frame decreases, a horizontal time may decrease, a scan on time (SOT) corresponding to an activation period of a scan signal may decrease, and thus a crosstalk may occur among the scan lines. As a result, when an organic light-emitting display device capable of selectively performing a displaying operation at different driving frequencies (e.g., capable of selectively operating at a driving frequency of 60 Hz or at a driving frequency of 120 Hz) has a relatively high resolution and operates at a relatively high speed, an image quality of the organic light-emitting display device may be rather deteriorated.

The above information disclosed in this Background section is only for enhancement of understanding of the background and therefore the information discussed in this Background section does not necessarily constitute prior art.

SUMMARY

Aspects of some example embodiments relate generally to an organic light-emitting display device. For example, some example embodiments according to the present inventive concept relate to an organic light-emitting display device that may be capable of selectively performing a displaying operation at different driving frequencies (e.g., capable of selectively operating at a driving frequency of 60 hertz (Hz) or at a driving frequency of 120 Hz).

Some example embodiments include an organic light-emitting display device that can enhance an image quality by preventing or reducing instances of a crosstalk occurring among scan lines by ensuring a sufficient horizontal time and a sufficient scan on time when the organic light-emitting display device capable of selectively performing a displaying operation at different driving frequencies operates at a relatively high speed.

According to some example embodiments, an organic light-emitting display device may include a display panel including a plurality of pixels, a data driver electrically connected to data lines of the display panel and configured to divide one frame into an odd-numbered sub-frame and an even-numbered sub-frame, to divide frame data for implementing the one frame into odd-numbered sub-frame data and even-numbered sub-frame data, to provide the odd-numbered sub-frame data to the data lines in the odd-numbered sub-frame, and to provide the even-numbered sub-frame data to the data lines in the even-numbered sub-frame, an odd-numbered scan driver electrically connected to odd-numbered scan lines among scan lines of the display panel and configured to provide an odd-numbered scan signal to the odd-numbered scan lines in the odd-numbered sub-frame, an even-numbered scan driver electrically connected to even-numbered scan lines among the scan lines and configured to provide an even-numbered scan signal to the even-numbered scan lines in the even-numbered sub-frame, an emission driver electrically connected to emission lines of the display panel and configured to provide an emission signal to emission line groups formed by grouping the emission lines by two adjacent emission lines in the odd-numbered sub-frame and the even-numbered sub-frame, and a timing controller configured to control the data driver, the odd-numbered scan driver, the even-numbered scan driver, and the emission driver.

According to some example embodiments, a non-light-emitting operation of target pixels electrically connected to a target emission line group to which the emission signal is applied may be simultaneously (or concurrently) performed in a deactivation period of the emission signal, and a light-emitting operation of the target pixels may be simultaneously (or concurrently) performed in an activation period of the emission signal.

According to some example embodiments, the timing controller may adjust luminance of the display panel by adjusting a ratio between the activation period and the deactivation period of the emission signal.

According to some example embodiments, in the odd-numbered sub-frame, during the deactivation period of the emission signal, a data writing operation of first target pixels electrically connected to the odd-numbered scan line among the target pixels may be performed, and a data writing operation of second target pixels electrically connected to the even-numbered scan line among the target pixels may not be performed.

According to some example embodiments, in the odd-numbered sub-frame, during the activation period of the emission signal, the first target pixels may emit light based on current odd-numbered sub-frame data, and the second target pixels may emit light based on previous even-numbered sub-frame data.

According to some example embodiments, in the even-numbered sub-frame, during the deactivation period of the emission signal, a data writing operation of first target pixels electrically connected to the odd-numbered scan line among the target pixels may not be performed, and a data writing operation of second target pixels electrically connected to the even-numbered scan line among the target pixels may be performed.

According to some example embodiments, in the even-numbered sub-frame, during the activation period of the emission signal, the first target pixels may emit light based on previous odd-numbered sub-frame data, and the second target pixels may emit light based on current even-numbered sub-frame data.

According to some example embodiments, the odd-numbered scan driver may include first to (2k−1)th scan stages that sequentially generate the odd-numbered scan signal, where k is an integer greater than or equal to 1. In addition, the odd-numbered scan driver may sequentially provide the odd-numbered scan signal to the odd-numbered scan lines when the timing controller applies an odd-numbered scan start signal to the first scan stage in the odd-numbered sub-frame.

According to some example embodiments, in the even-numbered sub-frame, the timing controller may not apply the odd-numbered scan start signal to the first scan stage, and clock signals applied to the first to (2k−1)th scan stages may have a low voltage level.

According to some example embodiments, the even-numbered scan driver may include second to (2k)th scan stages that sequentially generate the even-numbered scan signal. In addition, the even-numbered scan driver may sequentially provide the even-numbered scan signal to the even-numbered scan lines when the timing controller applies an even-numbered scan start signal to the second scan stage in the even-numbered sub-frame.

According to some example embodiments, in the odd-numbered sub-frame, the timing controller may not apply the even-numbered scan start signal to the second scan stage, and clock signals applied to the second to (2k)th scan stages may have a low voltage level.

According to some example embodiments, a pulse width of the odd-numbered scan start signal may be equal to a pulse width of the odd-numbered scan signal, and a pulse width of the even-numbered scan start signal may be equal to a pulse width of the even-numbered scan signal.

According to some example embodiments, a pulse width of the odd-numbered scan start signal may be greater than a pulse width of the odd-numbered scan signal, and a pulse width of the even-numbered scan start signal may be greater than a pulse width of the even-numbered scan signal.

According to some example embodiments, each of the emission line groups may include an odd-numbered emission line and an even-numbered emission line, and the odd-numbered emission line may not be electrically connected to the even-numbered emission line.

According to some example embodiments, the emission driver may include an odd-numbered emission driver that sequentially provides the emission signal to the odd-numbered emission lines and an even-numbered emission driver that sequentially provides the emission signal to the even-numbered emission lines, and the odd-numbered emission driver and the even-numbered emission driver may simultaneously (or concurrently) provide the emission signal to each of the emission line groups.

According to some example embodiments, the odd-numbered emission driver may be electrically connected to the odd-numbered emission lines and may include first to (2k−1)th emission stages that sequentially generate the emission signal, where k is an integer greater than or equal to 1. In addition, the odd-numbered emission driver may sequentially provide the emission signal to the odd-numbered emission lines when the timing controller applies an emission start signal to the first emission stage in the odd-numbered sub-frame and the even-numbered sub-frame.

According to some example embodiments, the even-numbered emission driver may be electrically connected to the even-numbered emission lines and may include second to (2k)th emission stages that sequentially generate the emission signal. In addition, the even-numbered emission driver may sequentially provide the emission signal to the even-numbered emission lines when the timing controller applies the emission start signal to the second emission stage in the odd-numbered sub-frame and the even-numbered sub-frame.

According to some example embodiments, the timing controller may simultaneously (or concurrently) apply the emission start signal to the first emission stage and the second emission stage in the odd-numbered sub-frame and the even-numbered sub-frame.

According to some example embodiments, each of the emission line groups may include an odd-numbered emission line and an even-numbered emission line, and the odd-numbered emission line may be electrically connected to the even-numbered emission line.

According to some example embodiments, the emission driver may be electrically connected to the emission line groups and may include first to (k)th emission stages that sequentially generate the emission signal. In addition, the emission driver may sequentially provide the emission signal to the emission line groups when the timing controller applies an emission start signal to the first emission stage in the odd-numbered sub-frame and the even-numbered sub-frame.

Therefore, an organic light-emitting display device according to some example embodiments may include a display panel including a plurality of pixels, a data driver that provides odd-numbered sub-frame data to data lines in an odd-numbered sub-frame and provides even-numbered sub-frame data to the data lines in an even-numbered sub-frame, an odd-numbered scan driver that provides an odd-numbered scan signal to odd-numbered scan lines in the odd-numbered sub-frame, an even-numbered scan driver that provides an even-numbered scan signal to even-numbered scan lines in the even-numbered sub-frame, an emission driver that provides an emission signal to emission line groups formed by grouping emission lines by two adjacent emission lines in the odd-numbered sub-frame and the even-numbered sub-frame, and a timing controller that controls the data driver, the odd-numbered scan driver, the even-numbered scan driver, and the emission driver. Thus, the organic light-emitting display device capable of selectively performing a displaying operation at different driving frequencies may secure a sufficient horizontal time and a sufficient scan on time when the organic light-emitting display device operates at a relatively high speed such that the organic light-emitting display device may prevent a crosstalk from occurring among the scan lines to enhance an image quality.

BRIEF DESCRIPTION OF THE DRAWINGS

Illustrative, non-limiting example embodiments will be more clearly understood from the following detailed description in conjunction with the accompanying drawings.

DETAILED DESCRIPTION

Hereinafter, aspects of some example embodiments of the present inventive concept will be explained in more detail with reference to the accompanying drawings.

Figure 1:
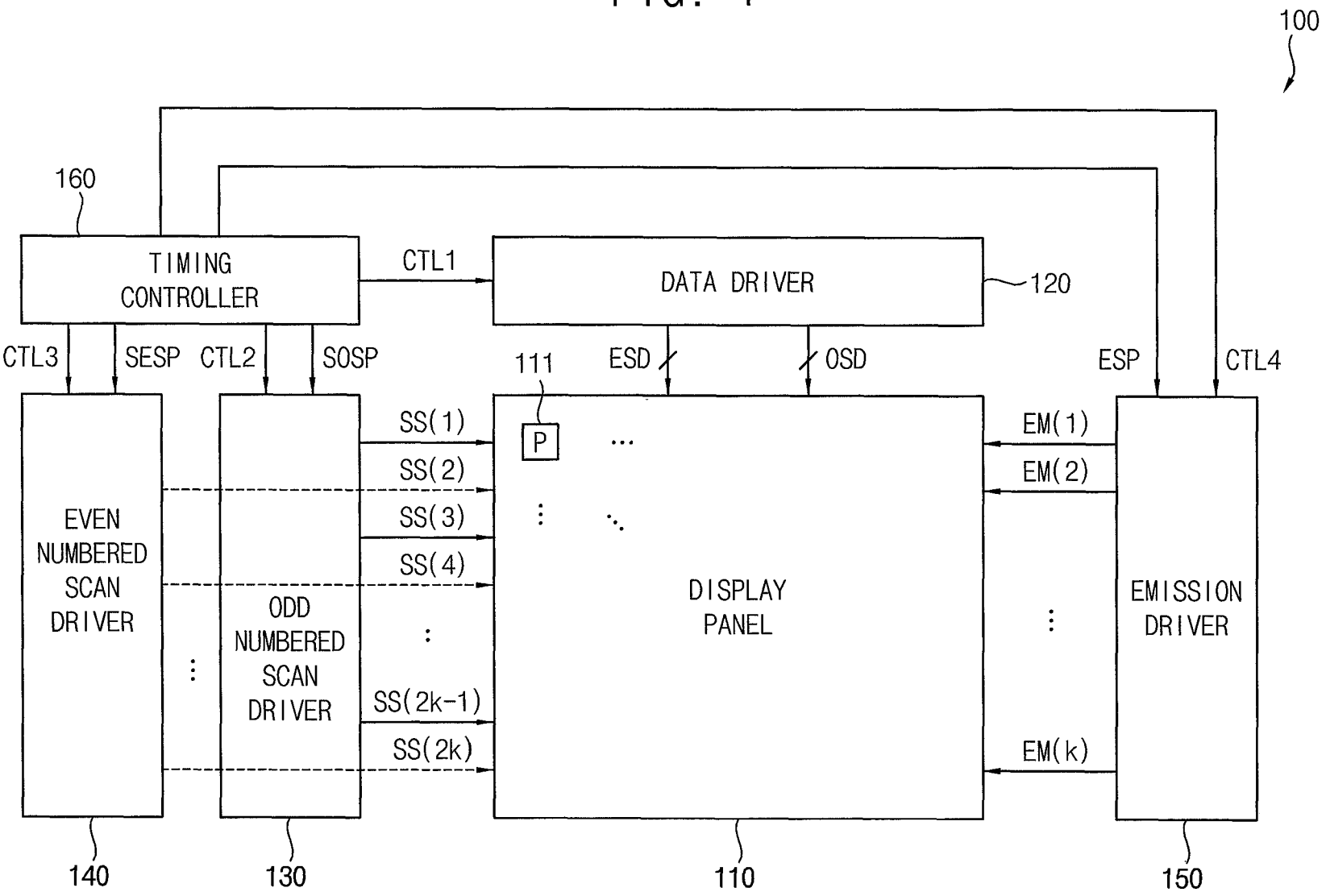
FIG. 1 is a block diagram illustrating an organic light-emitting display device according to some example embodiments.
Figure 2:
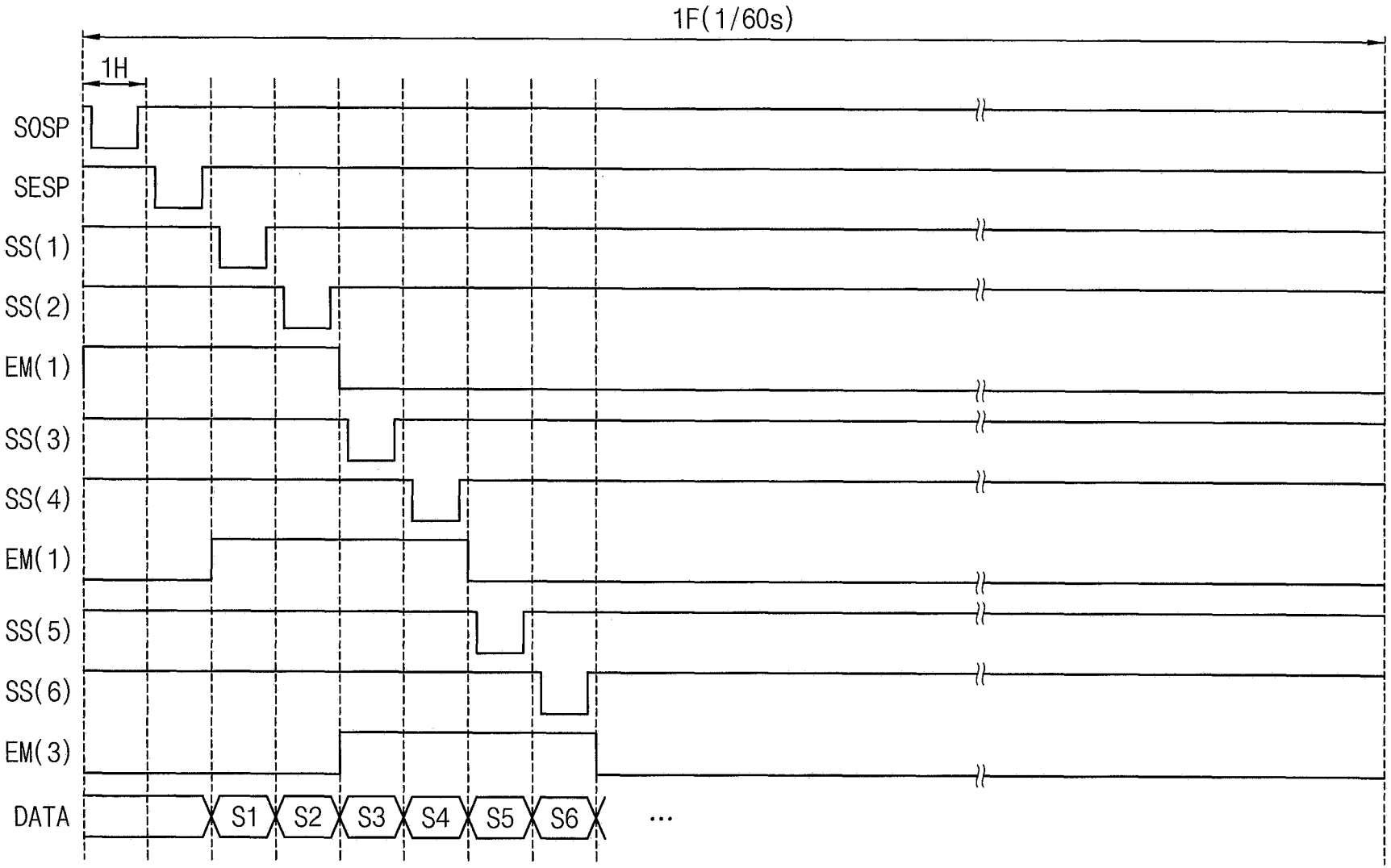
FIG. 2 is a diagram illustrating an example in which the organic light-emitting display device of FIG. 1 operates at a first driving frequency.
Figure 3:
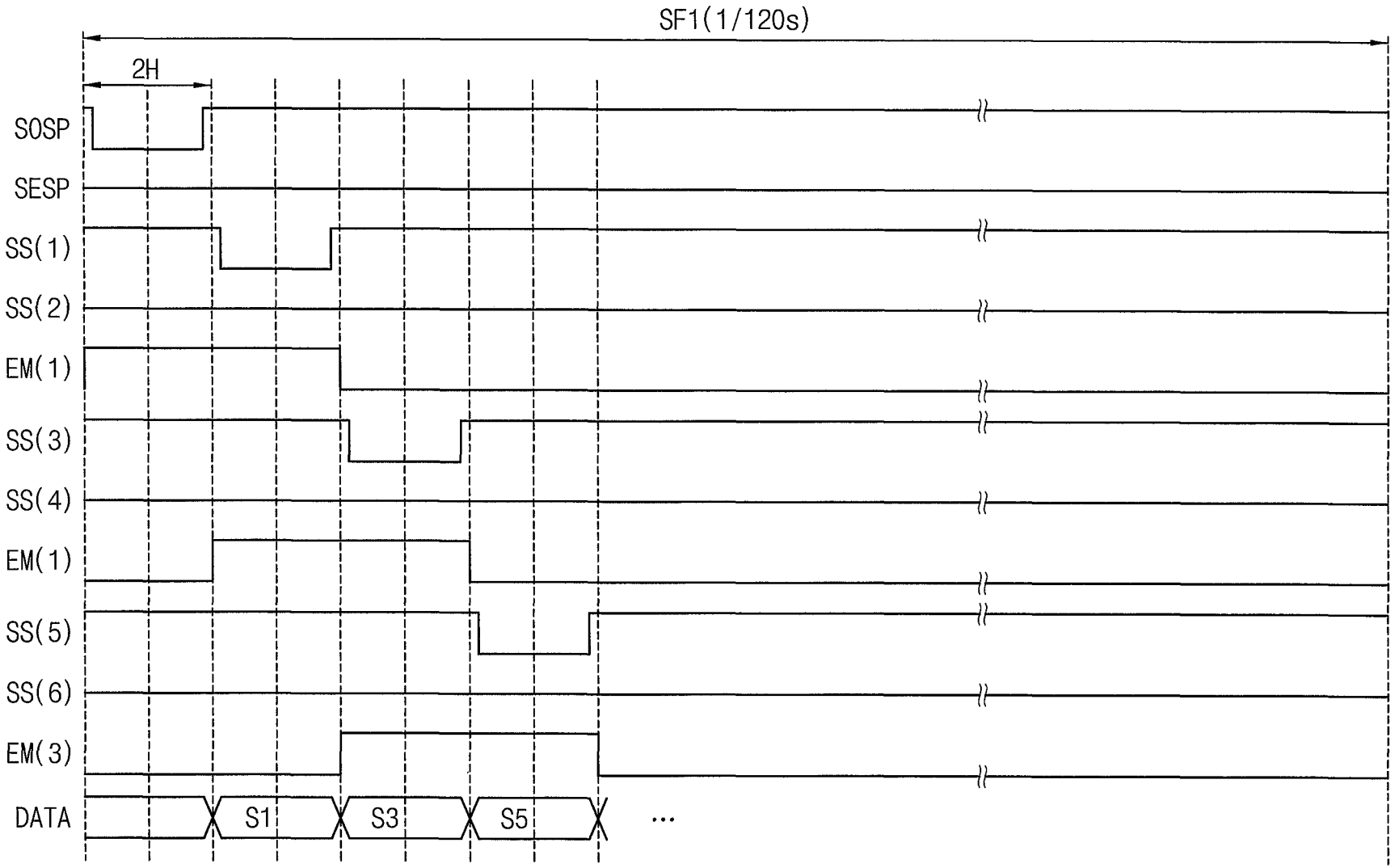
FIGS. 3 and 4 are diagrams illustrating an example in which the organic light-emitting display device of FIG. 1 operates at a second driving frequency.
Figure 4:
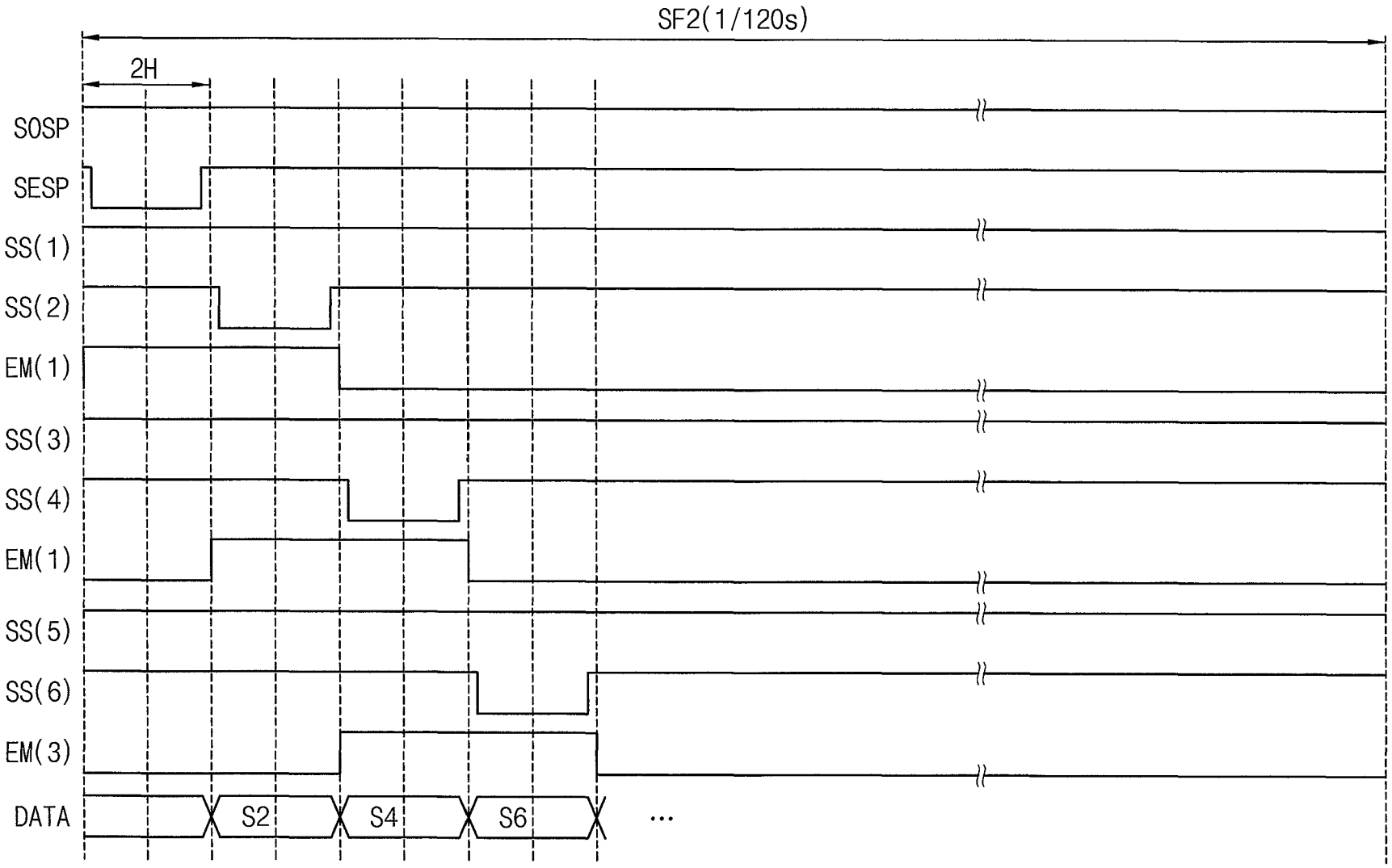

FIG. 1 is a block diagram illustrating an organic light-emitting display device according to some example embodiments, FIG. 2 is a diagram illustrating an example in which the organic light-emitting display device of FIG. 1 operates at a first driving frequency, and FIGS. 3 and 4 are diagrams illustrating an example in which the organic light-emitting display device of FIG. 1 operates at a second driving frequency.

Referring to FIGS. 1 to 4, the organic light-emitting display device 100 may include a display panel 110, a data driver 120, an odd-numbered scan driver 130, an even-numbered scan driver 140, an emission driver 150, and a timing controller 160. Here, the organic light-emitting display device 100 may selectively perform a displaying operation at different driving frequencies (e.g., may selectively operate in a driving frequency of 60 Hz or in a driving frequency of 120 Hz).

The display panel 110 may include a plurality of pixels 111. The pixels 111 may be arranged in various forms (e.g., a matrix form and the like) in the display panel 110. Each of the pixels 111 may include at least one of a red display pixel, a green display pixel, or a blue display pixel.

The data driver 120 may be electrically connected to data lines of the display panel 110. Here, when the organic light-emitting display device 100 operates at a first driving frequency (i.e., a relatively low driving frequency), the data driver 120 may provide frame data OSD and ESD for implementing one frame 1F to the data lines in the one frame 1F. For example, as illustrated in FIG. 2, when the organic light-emitting display device 100 operates at the first driving frequency (e.g., a driving frequency of 60 Hz), the data driver 120 may sequentially provide frame data DATA to the data lines (i.e., indicated by S1, S2, S3, S4, and the like) in response to scan signals SS(1), SS(2), SS(3), SS(4), and the like that are sequentially applied to scan lines in one frame 1F (i.e., during a frame time (e.g., 1/60 second)).

On the other hand, the organic light-emitting display device 100 operates at a second driving frequency (i.e., a relatively high driving frequency), the data driver 120 may divide one frame 1F into an odd-numbered sub-frame SF1 and an even-numbered sub-frame SF2, may divide the frame data OSD and ESD for implementing the one frame 1F into odd-numbered sub-frame data OSD and even-numbered sub-frame data ESD, may provide the odd-numbered sub-frame data OSD to the data lines in the odd-numbered sub-frame SF1, and may provide the even-numbered sub-frame data ESD to the data lines in the even-numbered sub-frame SF2.

For example, as illustrated in FIG. 3, the organic light-emitting display device 100 operates at the second driving frequency (e.g., a driving frequency of 120 Hz), the data driver 120 may sequentially provide the odd-numbered sub-frame data OSD to the data lines (i.e., indicated by S1, S3, S5, and the like) in response to the odd-numbered scan signals SS(1), SS(3), SS(5), and the like that are sequentially applied to the odd-numbered scan lines in the odd-numbered sub-frame SF1 (i.e., during a sub-frame time (e.g., 1/120 seconds)). In addition, as illustrated in FIG. 4, the organic light-emitting display device 100 operates at the second driving frequency (e.g., a driving frequency of 120 Hz), the data driver 120 may sequentially provide the even-numbered sub-frame data ESD to the data lines (i.e., indicated by S2, S4, S6, and the like) in response to the even-numbered scan signals SS(2), SS(4), SS(6), and the like that are sequentially applied to the even-numbered scan lines in the even-numbered sub-frame SF2 (i.e., during a sub-frame time (e.g., 1/120 seconds)).

The odd-numbered scan driver 130 may be electrically connected to odd-numbered scan lines among the scan lines of the display panel 110. The even-numbered scan driver 140 may be electrically connected to even-numbered scan lines among the scan lines of the display panel 110. Here, when the organic light-emitting display device 100 operates at the first driving frequency (i.e., a relatively low driving frequency), the scan driver (i.e., the odd-numbered scan driver 130 and the even-numbered scan driver 140) may sequentially provide the scan signal SS(1), SS(2), SS(3), SS(4), and the like to the scan lines in one frame 1F. For example, as illustrated in FIG. 2, when the organic light-emitting display device 100 operates at the first driving frequency (e.g., a driving frequency of 60 Hz), the odd-numbered scan driver 130 and the even-numbered scan driver 140 may operate as one scan driver to sequentially provide the scan signal SS(1), SS(2), SS(3), SS(4), and the like to the scan lines in one frame 1F (i.e., during a frame time (e.g., 1/60 seconds)).

On the other hand, when the organic light-emitting display device 100 operates at the second driving frequency (i.e., a relatively low driving frequency), the odd-numbered scan driver 130 may sequentially provide the odd-numbered scan signal SS(1), SS(3), SS(5), and the like to the odd-numbered scan lines in the odd-numbered sub-frame SF1, and the even-numbered scan driver 140 may sequentially provide the even-numbered scan signal SS(2), SS(4), SS(6), and the like to the even-numbered scan lines in the even-numbered sub-frame SF2. For example, as illustrated in FIG. 3, when the organic light-emitting display device 100 operates at the second driving frequency (e.g., a driving frequency of 120 Hz), the odd-numbered scan driver 130 may sequentially provide the odd-numbered scan signal SS(1), SS(3), SS(5), and the like to the odd-numbered scan lines in the odd-numbered sub-frame SF1 (i.e., during a sub-frame time (e.g., 1/120 seconds)). In addition, as illustrated in FIG. 4, when the organic light-emitting display device 100 operates at the second driving frequency (e.g., a driving frequency of 120 Hz), the even-numbered scan driver 140 may sequentially provide the even-numbered scan signal SS(2), SS(4), SS(6), and the like to the even-numbered scan lines in the even-numbered sub-frame SF2 (i.e., during a sub-frame time (e.g., 1/120 seconds)).

To this end, the odd-numbered scan driver 130 may include first to (2k−1)th scan stages that sequentially generate the odd-numbered scan signal SS(1), SS(3), SS(5), and the like, where k is an integer greater than or equal to 1, and may sequentially provide the odd-numbered scan signal SS(1), SS(3), SS(5), and the like to the odd-numbered scan lines when the timing controller 160 applies an odd-numbered scan start signal SOSP to the first scan stage in the odd-numbered sub-frame SF1. According to some example embodiments, as illustrated in FIG. 3, a pulse width of the odd-numbered scan start signal SOSP may be equal to a pulse width of the odd-numbered scan signal SS(1), SS(3), SS(5), and the like.

In addition, the even-numbered scan driver 140 may include first to (2k−1)th scan stages that sequentially generate the even-numbered scan signal SS(2), SS(4), SS(6), and the like and may sequentially provide the even-numbered scan signal SS(2), SS(4), SS(6), and the like to the even-numbered scan lines when the timing controller 160 applies an even-numbered scan start signal SESP to the second scan stage in the even-numbered sub-frame SF2. According to some example embodiments, as illustrated in FIG. 4, a pulse width of the even-numbered scan start signal SESP may be equal to a pulse width of the even-numbered scan signal SS(2), SS(4), SS(6), and the like. These operations will be described in detail with reference to FIGS. 8 and 9.

The emission driver may be electrically connected to emission lines of the display panel 110. Here, the emission lines may be grouped by two adjacent emission lines to form emission line groups. For example, as illustrated in FIGS. 2 to 4, a first emission line (i.e., the odd-numbered emission line) connected to pixels that are connected to a first scan line (i.e., the odd-numbered scan line) and a second emission line (i.e., the even-numbered emission line) connected to pixels that are connected to a second scan line (i.e., the even-numbered scan line) may compose a first emission line group, a third emission line (i.e., the odd-numbered emission line) connected to pixels that are connected to a third scan line (i.e., the odd-numbered scan line) and a fourth emission line (i.e., the even-numbered emission line) connected to pixels that are connected to a fourth scan line (i.e., the even-numbered scan line) may compose a second emission line group, a fifth emission line (i.e., the odd-numbered emission line) connected to pixels that are connected to a fifth scan line (i.e., the odd-numbered scan line) and a sixth emission line (i.e., the even-numbered emission line) connected to pixels that are connected to a sixth scan line (i.e., the even-numbered scan line) may compose a third emission line group, and a (2k−1)th emission line (i.e., the odd-numbered emission line) connected to pixels that are connected to a (2k−1)th scan line (i.e., the odd-numbered scan line) and a (2k)th emission line (i.e., the even-numbered emission line) connected to pixels that are connected to a (2k)th scan line (i.e., the even-numbered scan line) may compose a (k)th emission line group. Here, when the organic light-emitting display device 100 operates at the first driving frequency (i.e., a relatively low driving frequency), the emission driver 150 may provide an emission signal EM(1), EM(2), EM(3), and the like to the emission line groups formed by grouping the emission lines by two adjacent emission lines in one frame 1F.

For example, as illustrated in FIG. 2, when the organic light-emitting display device 100 operates at the first driving frequency (e.g., a driving frequency of 60 Hz), the emission driver 150 may sequentially provide the emission signal EM(1), EM(2), EM(3), and the like to the emission line groups in one frame 1F (i.e., during a frame time (e.g., 1/60 seconds)). On the other hand, when the organic light-emitting display device 100 operates at the second driving frequency (i.e., a relatively high driving frequency), the emission driver 150 may provide the emission signal EM(1), EM(2), EM(3), and the like to the emission line groups formed by grouping the emission lines by two adjacent emission lines in the odd-numbered sub-frame SF1 and the even-numbered sub-frame SF2.

For example, as illustrated in FIG. 3, when the organic light-emitting display device 100 operates at the second driving frequency (i.e., a driving frequency of 120 Hz), the emission driver 150 may sequentially provide the emission signal EM(1), EM(2), EM(3), and the like to the emission line groups in the odd-numbered sub-frame SF1 (i.e., during a sub-frame time (e.g., 1/120 seconds)). In addition, as illustrated in FIG. 4, when the organic light-emitting display device 100 operates at the second driving frequency (e.g., a driving frequency of 120 Hz), the emission driver 150 may sequentially provide the emission signal EM(1), EM(2), EM(3), and the like to the emission line groups in the even-numbered sub-frame SF2 (i.e., during a sub-frame time (e.g., 1/120 seconds)).

According to some example embodiments, each of the emission line groups may include the odd-numbered emission line and the even-numbered emission line, and the odd-numbered emission line and the even-numbered emission line may not be electrically connected to each other. In this case, the emission driver 150 may include an odd-numbered emission driver that sequentially provides the emission signal EM(1), EM(2), EM(3), and the like to the odd-numbered emission lines and an even-numbered emission driver that sequentially provides the emission signal EM(1), EM(2), EM(3), and the like to the even-numbered emission lines, and the odd-numbered emission driver and the even-numbered emission driver may simultaneously (or concurrently) provide the emission signal EM(1), EM(2), EM(3), and the like to each of the emission line groups.

Here, the odd-numbered emission driver may be electrically connected to the odd-numbered emission lines and may include first to (2k−1)th emission stages that sequentially generate the emission signal EM(1), EM(2), EM(3), and the like. In addition, the odd-numbered emission driver may sequentially provide the emission signal EM(1), EM(2), EM(3), and the like to the odd-numbered emission lines when the timing controller 160 applies an emission start signal ESP to the first emission stage in the odd-numbered sub-frame SF1 and the even-numbered sub-frame SF2. The even-numbered emission driver may be electrically connected to the even-numbered emission lines and may include second to (2k)th emission stages that sequentially generate the emission signal EM(1), EM(2), EM(3), and the like.

In addition, the even-numbered emission driver may sequentially provide the emission signal EM(1), EM(2), EM(3), and the like to the even-numbered emission lines when the timing controller 160 applies the emission start signal ESP to the second emission stage in the odd-numbered sub-frame SF1 and the even-numbered sub-frame SF2. The timing controller 160 may simultaneously (or concurrently) apply the emission start signal ESP to the first emission stage and the second emission stage in the odd-numbered sub-frame SF1 and the even-numbered sub-frame SF2. According to some example embodiments, each of the emission line groups may include the odd-numbered emission line and the even-numbered emission line, and the odd-numbered emission line and the even-numbered emission line may be electrically connected to each other. In this case, the emission driver 150 may be electrically connected to the emission line groups and may include first to (k)th emission stages that sequentially generate the emission signal EM(1), EM(2), EM(3), and the like. The emission driver 150 may sequentially provide the emission signal EM(1), EM(2), EM(3), and the like to the emission line groups when the timing controller 160 applies the emission start signal ESP to the first emission stage in the odd-numbered sub-frame SF1 and the even-numbered sub-frame SF2. These operations will be described in detail with reference to FIGS. 6 and 7.

The timing controller 160 may control the data driver 120, the odd-numbered scan driver 130, the even-numbered scan driver 140, and the emission driver 150. To this end, the timing controller 160 may generate first to fourth control signals CTL1, CTL4 to provide the first to fourth control signals CTL1, CTL4 to the data driver 120, the odd-numbered scan driver 130, the even-numbered scan driver 140, and the emission driver 150, respectively. The timing controller 160 may provide the odd-numbered scan start signal SOSP to the odd-numbered scan driver 130 such that the odd-numbered scan driver 130 may sequentially provide the odd-numbered scan signal SS(1), SS(3), SS(5), and the like to the odd-numbered scan lines.

For example, as illustrated in FIG. 2, the timing controller 160 may provide the odd-numbered scan start signal SOSP to the first scan stage of the odd-numbered scan driver 130 in one frame 1F such that the odd-numbered scan driver 130 may sequentially provide the odd-numbered scan signal SS(1), SS(3), SS(5), and the like to the odd-numbered scan lines. In addition, as illustrated in FIG. 3, the timing controller 160 may control the odd-numbered scan driver 130 to sequentially provide the odd-numbered scan signal SS(1), SS(3), SS(5), and the like to the odd-numbered scan lines by applying the odd-numbered scan start signal SOSP to the first scan stage of the odd-numbered scan driver 130 in the odd-numbered sub-frame SF1. On the other hand, as illustrated in FIG. 4, the timing controller 160 may control the odd-numbered scan driver 130 not to provide the odd-numbered scan signal SS(1), SS(3), SS(5), and the like to the odd-numbered scan lines by not applying the odd-numbered scan start signal SOSP to the first scan stage of the odd-numbered scan driver 130 in the even-numbered sub-frame SF2.

The timing controller 160 may provide the even-numbered scan start signal SESP to the even-numbered scan driver 140 such that the even-numbered scan driver 140 may sequentially provide the even-numbered scan signal SS(2), SS(4), SS(6), and the like to the even-numbered scan lines. For example, as illustrated in FIG. 2, the timing controller 160 may provide the even-numbered scan start signal SESP to the second scan stage of the even-numbered scan driver 140 in one frame 1F such that the even-numbered scan driver 140 may sequentially provide the even-numbered scan signal SS(2), SS(4), SS(6), and the like to the even-numbered scan lines. In addition, as illustrated in FIG. 4, the timing controller 160 may control the even-numbered scan driver 140 to sequentially provide the even-numbered scan signal SS(2), SS(4), SS(6), and the like to the even-numbered scan lines by applying the even-numbered scan start signal SESP to the second scan stage of the even-numbered scan driver 140 in the even-numbered sub-frame SF2.

On the other hand, as illustrated in FIG. 3, the timing controller 160 may control the even-numbered scan driver 140 not to provide the even-numbered scan signal SS(2), SS(4), SS(6), and the like to the even-numbered scan lines by not applying the even-numbered scan start signal SESP to the second scan stage of the even-numbered scan driver 140 in the odd-numbered sub-frame SF1. The timing controller 160 may provide an emission start signal ESP to the emission driver 150 such that the emission driver 150 may sequentially provide the emission signal EM(1), EM(2), EM(3), and the like to the emission line groups. For example, as illustrated in FIGS. 2 to 4, the timing controller 160 may control the emission driver 150 to sequentially provide the emission signal EM(1), EM(2), EM(3), and the like to the emission line groups by applying the emission start signal ESP to the first emission stage of the emission driver 150 in the odd-numbered sub-frame SF1 and the even-numbered sub-frame SF2 as well as one frame 1F. According to some example embodiments, the timing controller 160 may perform a specific processing (e.g., deterioration compensation and the like) on image data input from an external component.

As illustrated in FIGS. 2 to 4, a non-light-emitting operation (e.g., including an initializing operation, a threshold voltage compensating operation, a data writing operation, and the like) of target pixels electrically connected to a target emission line group to which the emission signal EM(1), EM(2), EM(3), and the like is applied may be simultaneously (or concurrently) performed in a deactivation period (i.e., a period having a high voltage level in FIGS. 2 to 4) of the emission signal EM(1), EM(2), EM(3), and the like, and a light-emitting operation of the target pixels electrically connected to the target emission line group to which the emission signal EM(1), EM(2), EM(3), and the like may be simultaneously (or concurrently) performed in an activation period (i.e., a period having a low voltage level in FIGS. 2 to 4) of the emission signal EM(1), EM(2), EM(3), and the like.

For example, as illustrated in FIGS. 2 to 4, because the activation period (i.e., the period having the low voltage level in FIGS. 2 to 4) of the even-numbered scan signal SS(2), SS(4), SS(6), and the like and/or the odd-numbered scan signal SS(1), SS(3), SS(5), and the like that are applied to the target pixels exists in the deactivation period of the emission signal EM(1), EM(2), EM(3), and the like that is applied to the target pixels, the data writing operation of the target pixels may be performed. On the other hand, as illustrated in FIGS. 2 to 4, because the deactivation period (i.e., the period having the high voltage level in FIGS. 2 to 4) of the even-numbered scan signal SS(2), SS(4), SS(6), and the like and/or the odd-numbered scan signal SS(1), SS(3), SS(5), and the like that are applied to the target pixels exists in the activation period of the emission signal EM(1), EM(2), EM(3), and the like that is applied to the target pixels, the light-emitting operation of the target pixels may be performed. For example, as illustrated in FIG. 3, in the odd-numbered sub-frame SF1, during the deactivation period of the emission signal EM(1), EM(2), EM(3), and the like, first target pixels electrically connected to the odd-numbered scan line to which the odd-numbered scan signal SS(1), SS(3), SS(5), and the like having an activation level is applied among the target pixels may perform the data writing operation, and second target pixels electrically connected to the even-numbered scan line to which the even-numbered scan signal SS(2), SS(4), SS(6), and the like having a deactivation level is applied among the target pixels may not perform the data writing operation.

As a result, in the odd-numbered sub-frame SF1, during the activation period of the emission signal EM(1), EM(2), EM(3), and the like, the first target pixels may emit light based on current odd-numbered sub-frame data (i.e., the odd-numbered sub-frame data OSD written by the data writing operation in a current odd-numbered sub-frame), and the second target pixels may emit light based on previous even-numbered sub-frame data (i.e., the even-numbered sub-frame data ESD written by the data writing operation in a previous even-numbered sub-frame). On the other hand, as illustrated in FIG. 4, in the even-numbered sub-frame SF2, during the deactivation period of the emission signal EM(1), EM(2), EM(3), and the like, the first target pixels electrically connected to the odd-numbered scan line to which the odd-numbered scan signal SS(1), SS(3), SS(5), and the like having an deactivation level is applied among the target pixels may not perform the data writing operation, and the second target pixels electrically connected to the even-numbered scan line to which the even-numbered scan signal SS(2), SS(4), SS(6), and the like having an activation level is applied among the target pixels may perform the data writing operation.

As a result, in the even-numbered sub-frame SF2, during the activation period of the emission signal EM(1), EM(2), EM(3), and the like, the first target pixels may emit light based on previous odd-numbered sub-frame data (i.e., the odd-numbered sub-frame data OSD written by the data writing operation in a previous odd-numbered sub-frame), and the second target pixels may emit light based on current even-numbered sub-frame data (i.e., the even-numbered sub-frame data ESD written by the data writing operation in a current even-numbered sub-frame).

As described above, the organic light-emitting display device 100 may include the display panel 110 including the pixels 111, the data driver 120, which is electrically connected to the data lines of the display panel 110, that divides one frame 1F into the odd-numbered sub-frame SF1 and the even-numbered sub-frame SF2, divides the frame data OSD and ESD for implementing one frame 1F into the odd-numbered sub-frame data OSD and the even-numbered sub-frame data ESD, provides the odd-numbered sub-frame data OSD to the data lines in the odd-numbered sub-frame SF1, and provides the even-numbered sub-frame data ESD to the data lines in the even-numbered sub-frame SF2, the odd-numbered scan driver 130, which is electrically connected to the odd-numbered scan lines among the scan lines of the display panel 110, that provides the odd-numbered scan signal SS(1), SS(3), SS(5), and the like to the odd-numbered scan lines in the odd-numbered sub-frame SF1, the even-numbered scan driver 140, which is electrically connected to the even-numbered scan lines among the scan lines of the display panel 110, that provides the even-numbered scan signal SS(2), SS(4), SS(6), and the like to the even-numbered scan lines in the even-numbered sub-frame SF2, the emission driver 150, which is electrically connected to the emission lines of the display panel 110, that provides the emission signal EM(1), EM(2), EM(3), and the like to the emission line groups formed by grouping the emission lines by two adjacent emission lines in the odd-numbered sub-frame SF1 and the even-numbered sub-frame SF2, and the timing controller 160 that controls the data driver 120, the odd-numbered scan driver 130, the even-numbered scan driver 140, and the emission driver 150.

Thus, the organic light-emitting display device 100 capable of selectively performing the displaying operation at different driving frequencies (e.g., capable of selectively operating at the driving frequency of 60 Hz or at the driving frequency of 120 Hz) may secure a sufficient horizontal time and a sufficient scan on time when the organic light-emitting display device 100 operates at a relatively high speed (i.e., the activation period 2H of the scan signal SS shown in FIGS. 3 and 4 is longer than the activation period 1H of the scan signal SS shown in FIG. 2, the scan on time of the scan signal SS shown in FIGS. 3 and 4 is longer than the scan on time of the scan signal SS shown in FIG. 2, and thus an effect of increasing the horizontal time is achieved). As a result, the organic light-emitting display device 100 may prevent or reduce instances of a crosstalk occurring among the scan lines to enhance an image quality. For convenience of description, although it is described above that the organic light-emitting display device 100 selectively operates at the driving frequency of 60 Hz or at the driving frequency of 120 Hz, the driving frequency of the organic light-emitting display device 100 is not limited thereto.

Figure 5:
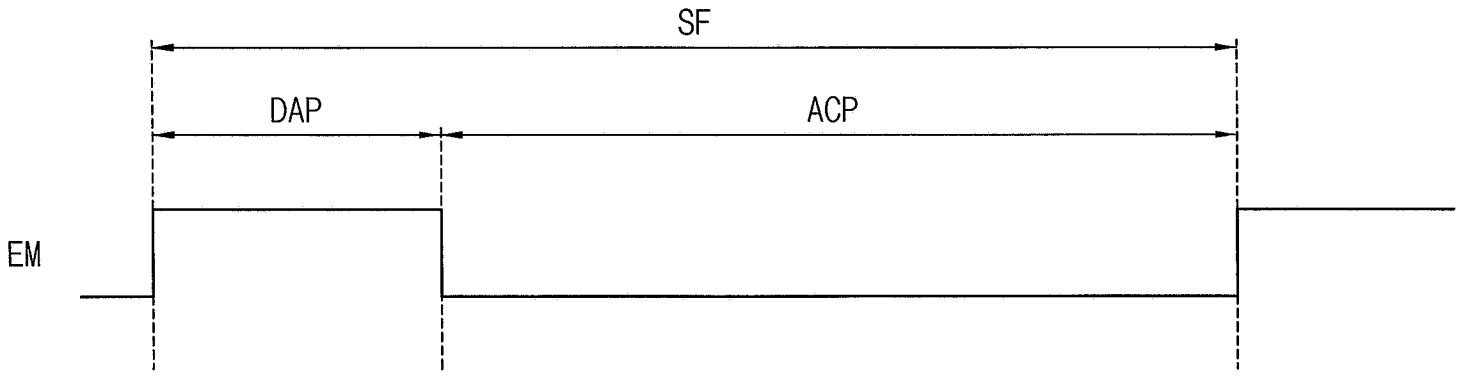
FIG. 5 is a diagram illustrating an emission signal generated by an emission driver included in the organic light-emitting display device of FIG. 1.

FIG. 5 is a diagram illustrating an emission signal generated by an emission driver included in the organic light-emitting display device of FIG. 1.

Referring to FIG. 5, when the organic light-emitting display device 100 is driven (i.e., operates) at a relatively high speed, the emission signal EM may include a deactivation period DAP and an activation period ACP in one sub-frame SF (i.e., in each of an odd-numbered sub-frame SF1 and an even-numbered sub-frame SF2). As described above, the pixels 111 may perform the non-light-emitting operation (e.g., including the initializing operation, the threshold voltage compensating operation, the data writing operation, and the like) in the deactivation period DAP of the emission signal EM and may perform the light-emitting operation in the activation period ACP of the emission signal EM.

In other words, as the deactivation period DAP of the emission signal EM is decreased and the activation period ACP of the emission signal EM is increased, luminance of the display panel 110 may be increased. On the other hand, as the deactivation period DAP of the emission signal EM is increased and the activation period ACP of the emission signal EM is decreased, the luminance of the display panel 110 may be decreased. Thus, the organic light-emitting display device 100 (for example, the timing controller 160) may adjust the luminance of the display panel 110 by adjusting a ratio between the activation period ACP and the deactivation period DAP of the emission signal EM.

Unlike an organic light-emitting display device employing an interlaced technique that divides one frame 1F into the odd-numbered sub-frame SF1 and the even-numbered sub-frame SF2, controls only the pixels 111 connected to the odd-numbered scan lines to emit light in the odd-numbered sub-frame SF1, and controls only the pixels 111 connected to the even-numbered scan lines to emit light in the even-numbered sub-frame SF2, the organic light-emitting display device 100 may divide one frame 1F into the odd-numbered sub-frame SF1 and the even-numbered sub-frame SF2, may control the pixels 111 connected to the even-numbered scan lines as well as the pixels 111 connected to the odd-numbered scan lines to emit light in the odd-numbered sub-frame SF1, and may control the pixels 111 connected to the odd-numbered scan lines as well as the pixels 111 connected to the even-numbered scan lines to emit light in the even-numbered sub-frame SF2. Thus, the organic light-emitting display device 100 may solve (or overcome) problems that the organic light-emitting display device employing the interlaced technique has (e.g., luminance deterioration, specific pattern afterimage, and the like).

Figure 6:
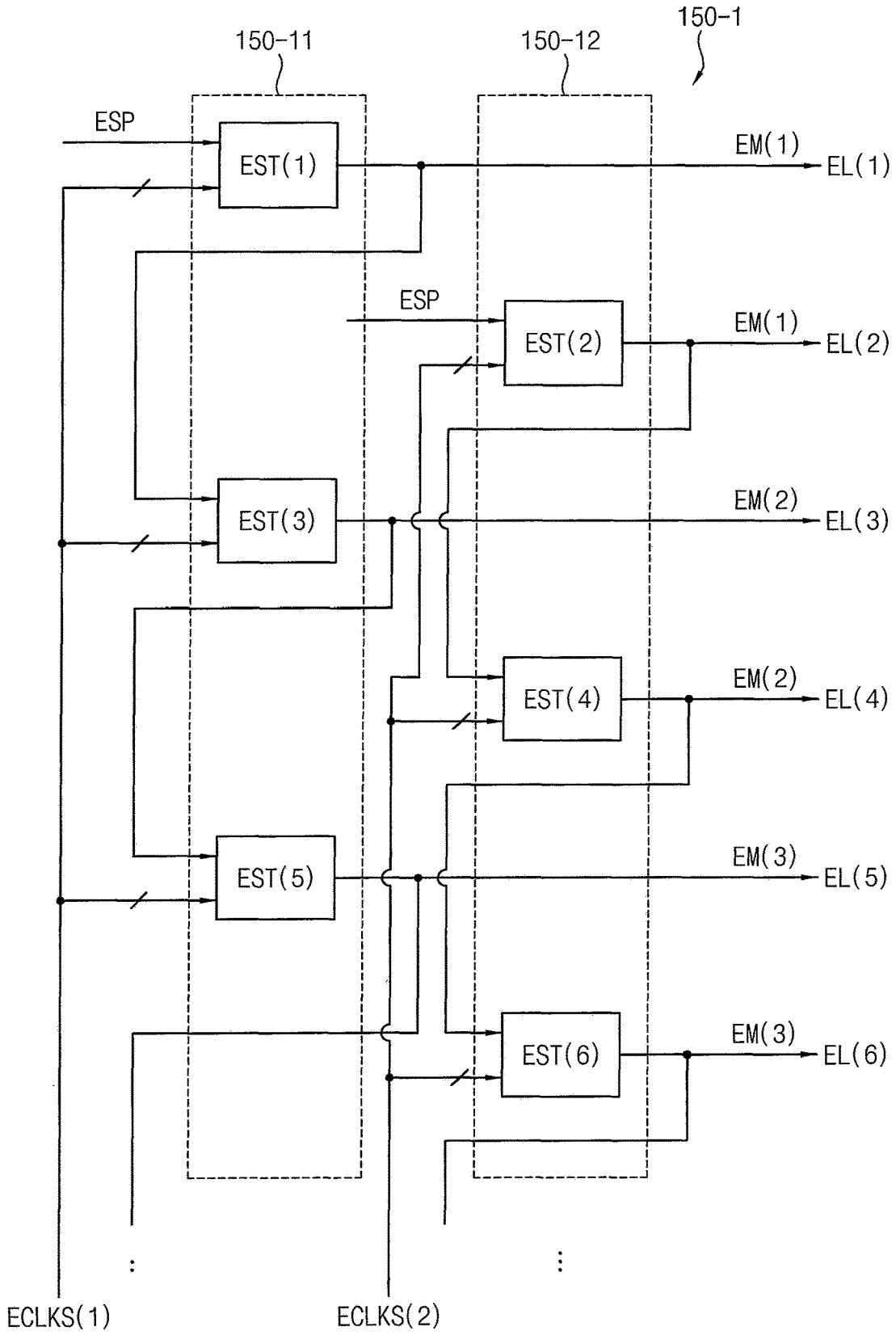
FIG. 6 is a block diagram illustrating an example of an emission driver included in the organic light-emitting display device of FIG. 1.

FIG. 6 is a block diagram illustrating an example of an emission driver included in the organic light-emitting display device of FIG. 1.

Referring to FIG. 6, the emission driver 150-1 may be electrically connected to the emission lines EL(1), EL(2), EL(3), EL(4), EL(5), EL(6), and the like of the display panel 110. Here, the emission lines EL(1), EL(2), EL(3), EL(4), EL(5), EL(6), and the like may be grouped by two adjacent emission lines to form (or compose) emission line groups. For example, the first emission line EL(1) and the second emission line EL(2) may compose a first emission line group, the third emission line EL(3) and the fourth emission line EL(4) may compose a second emission line group, the fifth emission line EL(5) and the sixth emission line EL(6) may compose a third emission line group, and the (2k−1)th emission line EL(2k−1) and the (2k)th emission line EL(2k) may compose a (k)th emission line group.

The emission driver 150-1 may sequentially provide the first to (k)th emission signals EM(1), . . . , EM(k) to the first to (k)th emission line groups. Here, as illustrated in FIG. 6, each of the first to (k)th emission line groups may include the odd-numbered emission line EL(1), EL(3), EL(5), and the like and the even-numbered emission line EL(2), EL(4), EL(6), and the like, and the odd-numbered emission line EL(1), EL(3), EL(5), and the like may not be electrically connected to the even-numbered emission line EL(2), EL(4), EL(6), and the like. In this case, the emission driver 150-1 may include an odd-numbered emission driver 150-11 that sequentially provides the emission signal EM(1), EM(2), EM(3), and the like to the odd-numbered emission lines EL(1), EL(3), EL(5), and the like and an even-numbered emission driver 150-12 that sequentially provides the emission signal EM(1), EM(2), EM(3), and the like to the even-numbered emission lines EL(2), EL(4), EL(6), and the like, and the odd-numbered emission driver 150-11 and the even-numbered emission driver 150-12 may simultaneously (or concurrently) provide the emission signal EM(1), . . . , EM(k) to each of the first to (k)th emission line groups.

Here, the odd-numbered emission driver 150-11 may be electrically connected to the odd-numbered emission lines EL(1), EL(3), EL(5), and the like and may include first to (2k−1)th emission stages EST(1), EST(3), EST(5), and the like that sequentially generate the first to (k)th emission signals EM(1), . . . , EM(k). The odd-numbered emission driver 150-11 may sequentially provide the first to (k)th emission signals EM(1), . . . , EM(k) to the odd-numbered emission lines EL(1), EL(3), EL(5), and the like when the timing controller 160 applies an emission start signal ESP to the first emission stage EST(1). For example, the first to (2k−1)th emission stages EST(1), EST(3), EST(5), and the like included in the odd-numbered emission driver 150-11 may sequentially generate the first to (k)th emission signals EM(1), . . . , EM(k) based on the emission start signal ESP (or an output signal of a previous emission stage) and first emission clock signals ECLKS(1).

In addition, the even-numbered emission driver 150-12 may be electrically connected to the even-numbered emission lines EL(2), EL(4), EL(6), and the like and may include second to (2k)th emission stages EST(2), EST(4), EST(6), and the like that sequentially generate the first to (k)th emission signals EM(1), . . . , EM(k). The even-numbered emission driver 150-12 may sequentially provide the first to (k)th emission signals EM(1), . . . , EM(k) to the even-numbered emission lines EL(2), EL(4), EL(6), and the like when the timing controller 160 applies the emission start signal ESP to the second emission stage EST(2). For example, the second to (2k)th emission stages EST(2), EST(4), EST(6), and the like included in the even-numbered emission driver 150-12 may sequentially generate the first to (k)th emission signals EM(1), . . . , EM(k) based on the emission start signal ESP (or an output signal of a previous emission stage) and second emission clock signals ECLKS (2). According to some example embodiments, the first emission clock signals ECLKS(1) may be the same as the second emission clock signals ECLKS(2), and thus the first emission clock signals ECLKS(1) and the second emission clock signals ECLKS(2) may be shared by the odd-numbered emission driver 150-11 and the even-numbered emission driver 150-12.

The timing controller 160 may simultaneously (or concurrently) apply the emission start signal ESP to the first emission stage EST(1) of the odd-numbered emission driver 150-11 and the second emission stage EST(2) of the even-numbered emission driver 150-12. For example, the first emission stage EST(1) and the second emission stage EST (2) may simultaneously (or concurrently) apply the first emission signal EM(1) to the first emission line group (i.e., the first emission line EL(1) and the second emission line EL(2)), the third emission stage EST(3) and the fourth emission stage EST(4) may simultaneously (or concurrently) apply the second emission signal EM(2) to the second emission line group (i.e., the third emission line EL(3) and the fourth emission line EL(4)), the fifth emission stage EST(5) and the sixth emission stage EST(6) may simultaneously (or concurrently) apply the third emission signal EM(3) to the third emission line group (i.e., the fifth emission line EL(5) and the sixth emission line EL(6)), and the (2k−1)th emission stage EST(2k−1) and the (2k)th emission stage EST(2k) may simultaneously (or concurrently) apply the (k)th emission signal EM(k) to the (k)th emission line group (i.e., the (2k−1)th emission line EL(2k−1) and the (2k)th emission line EL(2k)).

Figure 7:
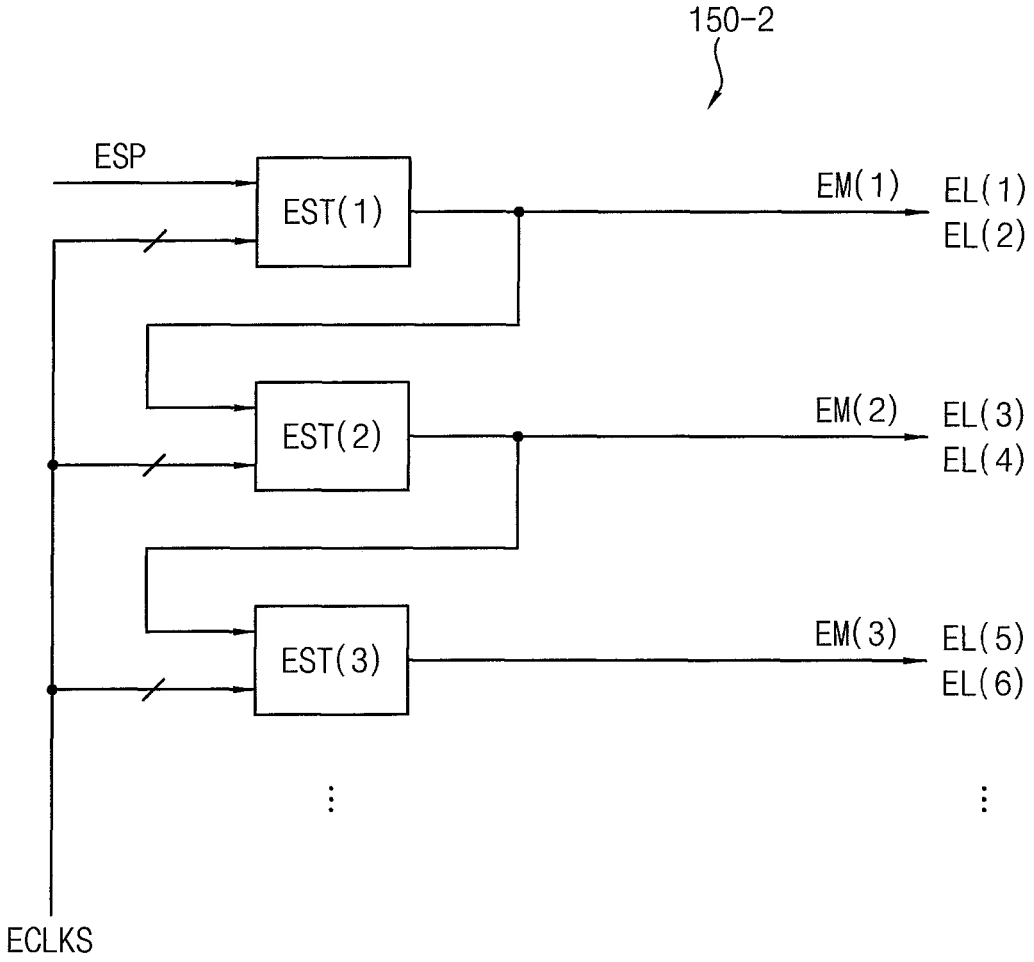
FIG. 7 is a block diagram illustrating another example of an emission driver included in the organic light-emitting display device of FIG. 1.

FIG. 7 is a block diagram illustrating another example of an emission driver included in the organic light-emitting display device of FIG. 1.

Referring to FIG. 7, the emission driver 150-2 may be electrically connected to the emission lines EL(1), EL(2), EL(3), EL(4), EL(5), EL(6), and the like of the display panel 110. Here, the emission lines EL(1), EL(2), EL(3), EL(4), EL(5), EL(6), and the like may be grouped by two adjacent emission lines to form emission line groups. For example, the first emission line EL(1) and the second emission line EL(2) may compose a first emission line group, the third emission line EL(3) and the fourth emission line EL(4) may compose a second emission line group, the fifth emission line EL(5) and the sixth emission line EL(6) may compose a third emission line group, and the (2k−1)th emission line EL(2k−1) and the (2k)th emission line EL(2k) may compose a (k)th emission line group.

The emission driver 150-2 may sequentially provide the first to (k)th emission signals EM(1), . . . , EM(k) to the first to (k)th emission line groups. Here, as illustrated in FIG. 7, each of the first to (k)th emission line groups may include the odd-numbered emission line EL(1), EL(3), EL(5), and the like and the even-numbered emission line EL(2), EL(4), EL(6), and the like, and the odd-numbered emission line EL(1), EL(3), EL(5), and the like may be electrically connected to the even-numbered emission line EL(2), EL(4), EL(6), and the like. In this case, the emission driver 150-2 may be electrically connected to the first to (k)th emission line groups and may include first to (k)th emission stages EST(1), . . . , EST(k) that sequentially generate the first to (k)th emission signals EM(1), . . . , EM(k). The emission driver 150-2 may sequentially provide the first to (k)th emission signals EM(1), . . . , EM(k) to the first to (k)th emission line groups when the timing controller 160 applies the emission start signal ESP to the first emission stage EST(1). For example, the first to (k)th emission stages EST(1), . . . , EST(k) included in the emission driver 150-2 may sequentially generate the first to (k)th emission signals EM(1), . . . , EM(k) based on the emission start signal ESP (or an output signal of a previous emission stage) and emission clock signals ECLKS.

For example, the first emission stage EST(1) may simultaneously (or concurrently) apply the first emission signal EM(1) to the first emission line group (i.e., the first emission line EL(1) and the second emission line EL(2)), the second emission stage EST(2) may simultaneously (or concurrently) apply the second emission signal EM(2) to the second emission line group (i.e., the third emission line EL(3) and the fourth emission line EL(4)), the third emission stage EST(3) may simultaneously (or concurrently) apply the third emission signal EM(3) to the third emission line group (i.e., the fifth emission line EL(5) and the sixth emission line EL(6)), and the (k)th emission stage EST(k) may simultaneously (or concurrently) apply the (k)th emission signal EM(k) to the (k)th emission line group (i.e., the (2k−1)th emission line EL(2k−1) and the (2k)th emission line EL(2k)).

Figure 8:
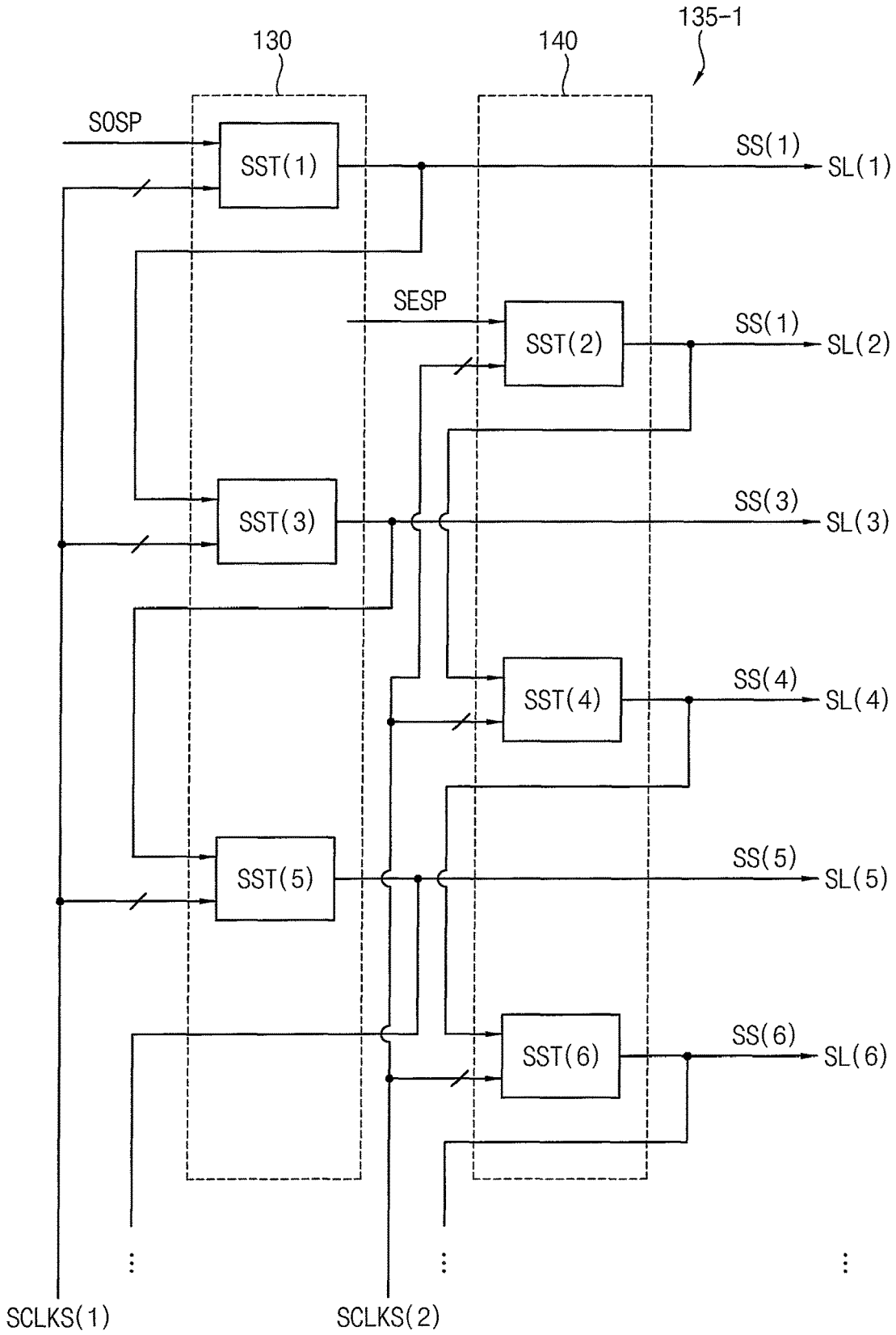
FIG. 8 is a diagram illustrating an example of a scan driver included in the organic light-emitting display device of FIG. 1.

FIG. 8 is a diagram illustrating an example of a scan driver included in the organic light-emitting display device of FIG. 1.

Referring to FIG. 8, the scan driver 135-1 may be electrically connected to the scan lines SL(1), SL(2), SL(3), SL(4), SL(5), SL(6), and the like of the display panel 110. Here, the scan driver 135-1 may include the odd-numbered scan driver 130 electrically connected to the odd-numbered scan lines SL(1), SL(3), SL(5), and the like among the scan lines SL(1), SL(2), SL(3), SL(4), SL(5), SL(6), and the like of the display panel 110 and configured to provide the odd-numbered scan signal SS(1), SS(3), SS(5), and the like to the odd-numbered scan lines SL(1), SL(3), SL(5), and the like in the odd-numbered sub-frame SF1 and the even-numbered scan driver 140 electrically connected to the even-numbered scan lines SL(2), SL(4), SL(6), and the like among the scan lines SL(1), SL(2), SL(3), SL(4), SL(5), SL(6), and the like of the display panel 110 and configured to provide the even-numbered scan signal SS(2), SS(4), SS(6), and the like to the even-numbered scan lines SL(2), SL(4), SL(6), and the like in the even-numbered sub-frame SF2.

For example, as illustrated in FIG. 8, the odd-numbered scan driver 130 may include the first to (2k−1)th scan stages SST(1), SST(3), SST(5), and the like that sequentially generate the odd-numbered scan signal SS(1), SS(3), SS(5), and the like. The odd-numbered scan driver 130 may sequentially provide the odd-numbered scan signal SS(1), SS(3), SS(5), and the like to the odd-numbered scan lines SL(1), SL(3), SL(5), and the like when the timing controller 160 applies an odd-numbered scan start signal SOSP to the first scan stage SST(1) in the odd-numbered sub-frame SF1.

For example, the first to (2k−1)th scan stages SST(1), SST(3), SST(5), and the like included in the odd-numbered scan driver 130 may sequentially generate the odd-numbered scan signal SS(1), SS(3), SS(5), and the like based on the odd-numbered scan start signal SOSP (or an output signal of a previous scan stage) and first clock signals SCLKS(1). According to some example embodiments, in the even-numbered sub-frame SF2, the timing controller 160 may not apply the odd-numbered scan start signal SOSP to the first scan stage SST(1), and the first clock signals SCLKS(1) applied to the first to (2k−1)th scan stages SST(1), SST(3), SST(5), and the like may have a low voltage level. In this case, the first to (2k−1)th scan stages SST(1), SST(3), SST(5), and the like may not operate in the even-numbered sub-frame SF2, and thus the organic light-emitting display device 100 may not consume unnecessary power.

In addition, the even-numbered scan driver 140 may include the second to (2k)th scan stages SST(2), SST(4), SST(6), and the like that sequentially generate the even-numbered scan signal SS(2), SS(4), SS(6), and the like. The even-numbered scan driver 140 may sequentially provide the even-numbered scan signal SS(2), SS(4), SS(6), and the like to the even-numbered scan lines SL(2), SL(4), SL(6), and the like when the timing controller 160 applies an even-numbered scan start signal SESP to the second scan stage SST(2) in the even-numbered sub-frame SF2. For example, the second to (2k)th scan stages SST(2), SST(4), SST(6), and the like included in the even-numbered scan driver 140 may sequentially generate the even-numbered scan signal SS(2), SS(4), SS(6), and the like based on the even-numbered scan start signal SESP (or an output signal of a previous scan stage) and second clock signals SCLKS(2). According to some example embodiments, in the odd-numbered sub-frame SF1, the timing controller 160 may not apply the even-numbered scan start signal SESP to the second scan stage SST(2), and the second clock signals SCLKS(2) applied to the second to (2k)th scan stages SST(2), SST(4), SST(6), and the like may have a low voltage level. In this case, the second to (2k)th scan stages SST(2), SST(4), SST(6), and the like may not operate in the odd-numbered sub-frame SF1, and thus the organic light-emitting display device 100 may not consume unnecessary power.

Figure 9:
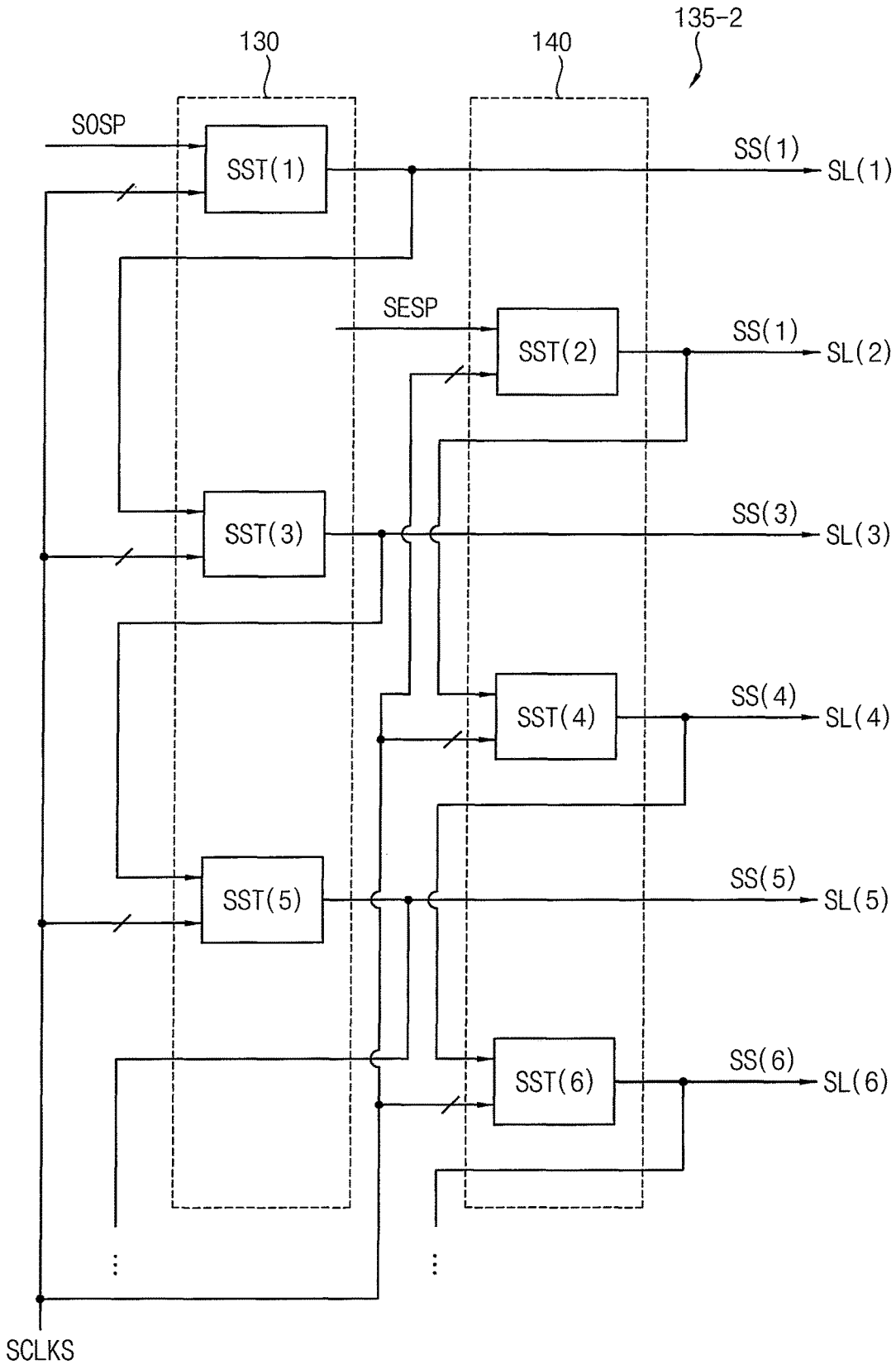
FIG. 9 is a diagram illustrating another example of a scan driver included in the organic light-emitting display device of FIG. 1.

FIG. 9 is a diagram illustrating another example of a scan driver included in the organic light-emitting display device of FIG. 1.

Referring to FIG. 9, the scan driver 135-2 may be electrically connected to the scan lines SL(1), SL(2), SL(3), SL(4), SL(5), SL(6), and the like of the display panel 110. Here, the scan driver 135-2 may include the odd-numbered scan driver 130 and the even-numbered scan driver 140. The odd-numbered scan driver 130 may be electrically connected to the odd-numbered scan lines SL(1), SL(3), SL(5), and the like among the scan lines SL(1), SL(2), SL(3), SL(4), SL(5), SL(6), and the like of the display panel 110.

The odd-numbered scan driver 130 may provide the odd-numbered scan signal SS(1), SS(3), SS(5), and the like to the odd-numbered scan lines SL(1), SL(3), SL(5), and the like in the odd-numbered sub-frame SF1. The even-numbered scan driver 140 may be electrically connected to the even-numbered scan lines SL(2), SL(4), SL(6), and the like among the scan lines SL(1), SL(2), SL(3), SL(4), SL(5), SL(6), and the like of the display panel 110. The even-numbered scan driver 140 may provide the even-numbered scan signal SS(2), SS(4), SS(6), and the like to the even-numbered scan lines SL(2), SL(4), SL(6), and the like in the even-numbered sub-frame SF2. Unlike the scan driver 135-1 of FIG. 8, the odd-numbered scan driver 130 and the even-numbered scan driver 140 of the scan driver 135-2 may share the clock signals SCLKS.

That is, a structure of the scan driver 135-2 may be simplified as compared to a structure of the scan driver 135-1 of FIG. 8. However, the organic light-emitting display device 100 including the scan driver 135-2 may not selectively perform a displaying operation at different driving frequencies (e.g., may not selectively operate at a driving frequency of 60 Hz or at a driving frequency of 120 Hz). In other words, the organic light-emitting display device 100 including the scan driver 135-2 may perform the displaying operation only at a specific driving frequency (e.g., at the driving frequency of 120 Hz).

Figure 10A:
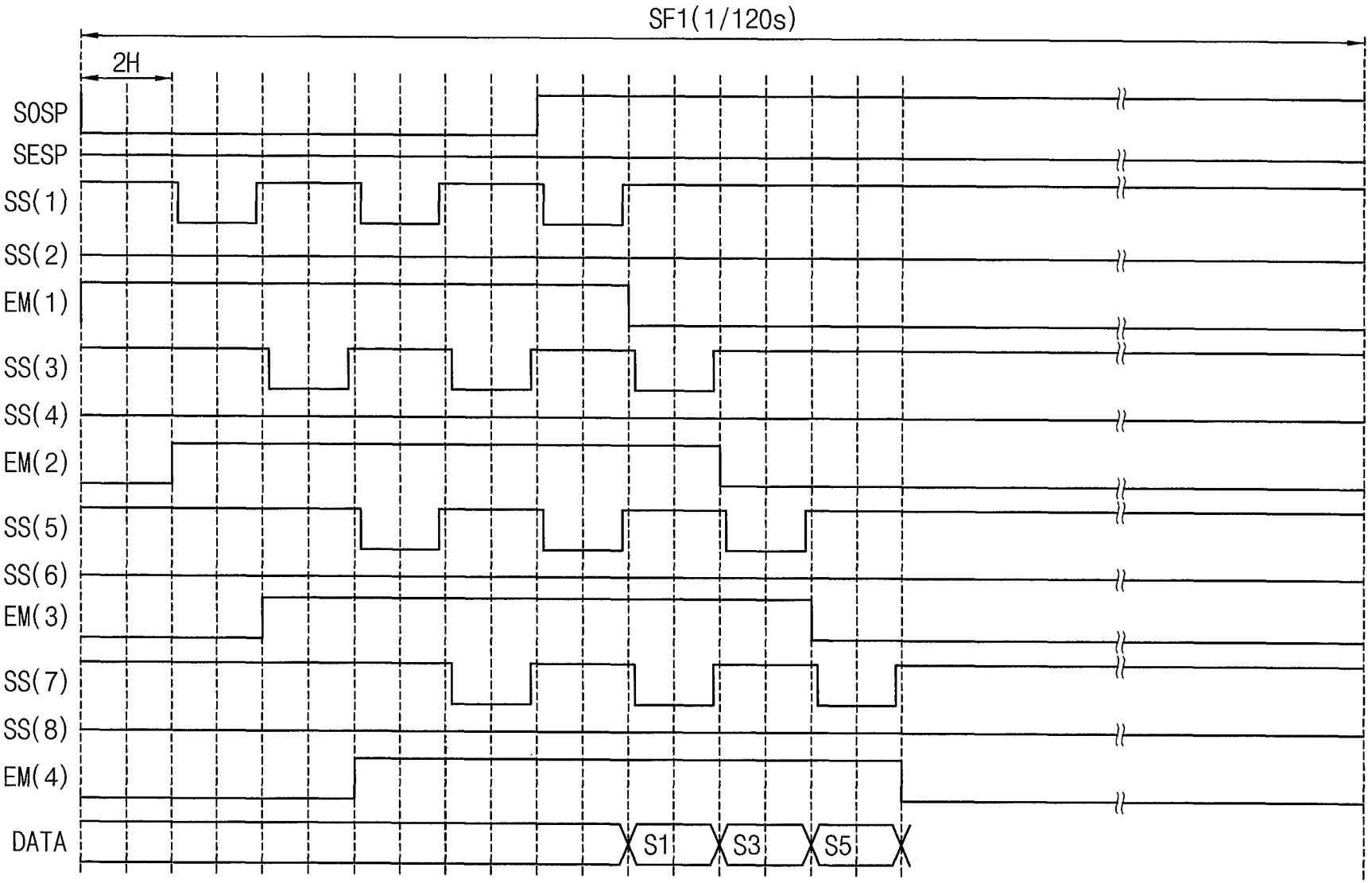
FIGS. 10A and 10B are diagrams illustrating an example in which the organic light-emitting display device of FIG. 1 toggles and outputs a scan signal.
Figure 10B:
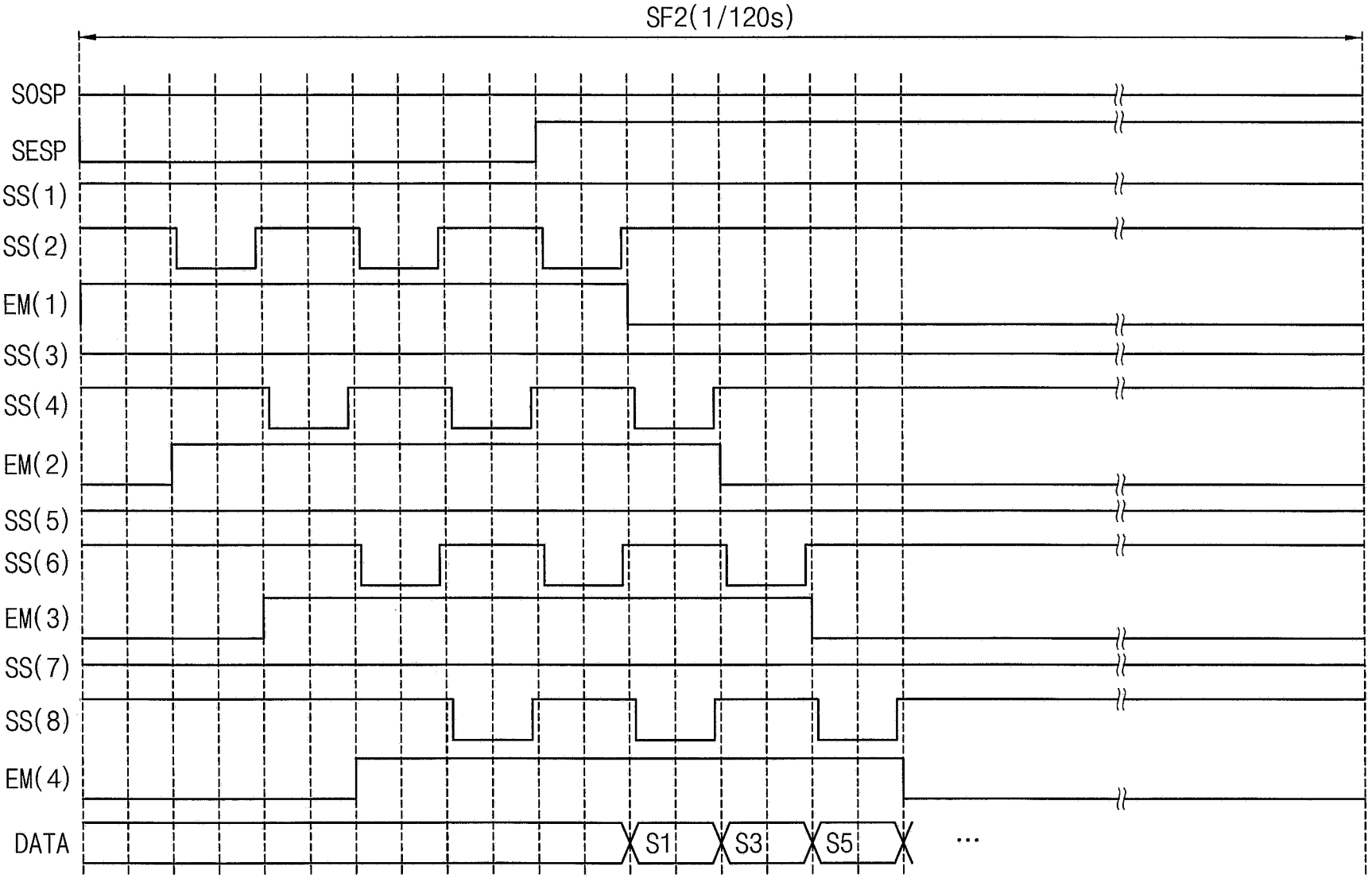

FIGS. 10A and 10B are diagrams illustrating an example in which the organic light-emitting display device of FIG. 1 toggles and outputs a scan signal.

Referring to FIGS. 10A and 10B, a pulse width of the odd-numbered scan start signal SOSP may be greater than a pulse width of the odd-numbered scan signal SS(1), SS(3), SS(5), and the like, and a pulse width of the even-numbered scan start signal SESP may be greater than a pulse width of the even-numbered scan signal SS(2), SS(4), SS(6), and the like. For example, as illustrated in FIG. 10A, when the timing controller 160 provides the odd-numbered scan start signal SOSP having an increased pulse width to the odd-numbered scan driver 130, the odd-numbered scan driver 130 may toggle and output the odd-numbered scan signal SS(1), SS(3), SS(5), and the like. Here, an effective pulse synchronized with the odd-numbered sub-frame data S1, S3, S5, and the like may be a last pulse of the odd-numbered scan signal SS(1), SS(3), SS(5), and the like (i.e., a third pulse of the odd-numbered scan signal SS(1), SS(3), SS(5), and the like in FIG. 10A), and the driving deviation of a driving transistor inside the pixel 111 included in the display panel 110 may be compensated by the remaining pulses.

In addition, as illustrated in FIG. 11B, when the timing controller 160 provides the even-numbered scan start signal SESP having an increased pulse width to the even-numbered scan driver 140, the even-numbered scan driver 140 may toggle and output the even-numbered scan signal SS(2), SS(4), SS(6), and the like. Here, an effective pulse synchronized with the even-numbered sub-frame data S2, S4, S6, and the like may be a last pulse of the even-numbered scan signal SS(2), SS(4), SS(6), and the like (i.e., a third pulse of the even-numbered scan signal SS(2), SS(4), SS(6), and the like in FIG. 10B), and the driving deviation of the driving transistor inside the pixel 111 included in the display panel 110 may be compensated by the remaining pulses. Because toggling forms of the odd-numbered scan signal SS(1), SS(3), SS(5), and the like and the even-numbered scan signal SS(2), SS(4), SS(6), and the like shown in FIGS. 10A and 10B are examples, according to requirements, the number of pulses, the pulse width, and the like of the odd-numbered scan signal SS(1), SS(3), SS(5), and the like and the even-numbered scan signal SS(2), SS(4), SS(6), and the like may be changed in various ways.

Figure 11:
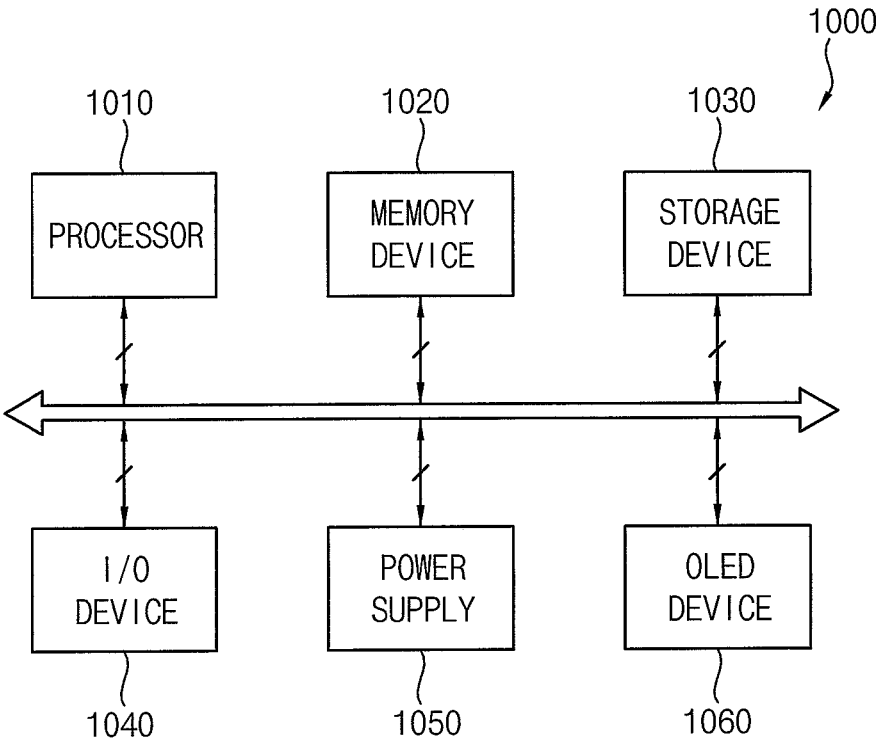
FIG. 11 is a block diagram illustrating an electronic device according to some example embodiments.
Figure 12:
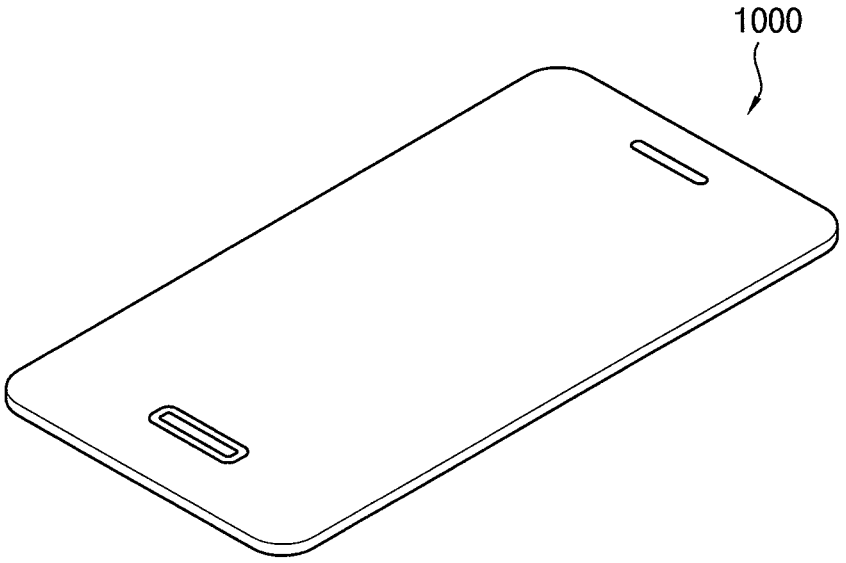
FIG. 12 is a diagram illustrating an example in which the electronic device of FIG. 11 is implemented as a smart phone.

FIG. 11 is a block diagram illustrating an electronic device according to embodiments, and FIG. 12 is a diagram illustrating an example in which the electronic device of FIG. 11 is implemented as a smart phone.

Referring to FIGS. 11 and 12, the electronic device 1000 may include a processor 1010, a memory device 1020, a storage device 1030, an input/output (I/O) device 1040, a power supply 1050, and an organic light-emitting display device 1060. Here, the organic light-emitting display device 1060 may be the organic light-emitting display device 100 of FIG. 1. In addition, the electronic device 1000 may further include a plurality of ports for communicating with a video card, a sound card, a memory card, a universal serial bus (USB) device, other electronic devices, and the like. According to some example embodiments, as illustrated in FIG. 12, the electronic device 1000 may be implemented as a smart phone. However, the electronic device 1000 is not limited thereto. For example, the electronic device 1000 may be implemented as a cellular phone, a video phone, a smart pad, a smart watch, a tablet PC, a car navigation system, a computer monitor, a laptop, a head mounted display (HMD) device, and the like.

The processor 1010 may perform various computing functions. The processor 1010 may be a micro processor, a central processing unit (CPU), an application processor (AP), and the like. The processor 1010 may be coupled to other components via an address bus, a control bus, a data bus, and the like. Further, the processor 1010 may be coupled to an extended bus such as a peripheral component interconnection (PCI) bus. The memory device 1020 may store data for operations of the electronic device 1000. For example, the memory device 1020 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, and the like and/or at least one volatile memory device such as a dynamic random access memory (DRAM) device, a static random access memory (SRAM) device, a mobile DRAM device, and the like. The storage device 1030 may include a solid state drive (SSD) device, a hard disk drive (HDD) device, a CD-ROM device, and the like. The I/O device 1040 may include an input device such as a keyboard, a keypad, a mouse device, a touch-pad, a touch-screen, and the like, and an output device such as a printer, a speaker, and the like. According to some example embodiments, the I/O device 1040 may include the organic light-emitting display device 1060. The power supply 1050 may provide power for operations of the electronic device 1000.

The organic light-emitting display device 1060 may display an image corresponding to visual information of the electronic device 1000. The organic light-emitting display device 1060 may be coupled to other components via the buses or other communication links. The organic light-emitting display device 1060 may selectively perform a displaying operation at different driving frequencies (e.g., may selectively operate at a driving frequency of 60 Hz or at a driving frequency of 120 Hz). Here, the organic light-emitting display device 1060 may include a display panel, a data driver, an odd-numbered scan driver, an even-numbered scan driver, an emission driver, and a timing controller. The display panel may include a plurality of pixels. The data driver may be electrically connected to data lines. Here, when the organic light-emitting display device 1060 operates at a first driving frequency (i.e., a relatively low driving frequency), the data driver may provide frame data for implementing one frame to the data lines in the one frame. On the other hand, when the organic light-emitting display device 1060 operates at a second driving frequency (i.e., a relatively high driving frequency), the data driver may divide one frame into an odd-numbered sub-frame and an even-numbered sub-frame, may divide the frame data for implementing the one frame into odd-numbered sub-frame data and even-numbered sub-frame data, may provide the odd-numbered sub-frame data to the data lines in the odd-numbered sub-frame, and may provide the even-numbered sub-frame data to the data lines in the even-numbered sub-frame. The odd-numbered scan driver may be electrically connected to odd-numbered scan lines among scan lines. The even-numbered scan driver may be electrically connected to even-numbered scan lines among the scan lines. Here, when the organic light-emitting display device 1060 operates at a first driving frequency, the scan driver (i.e., the odd-numbered scan driver and the even-numbered scan driver) may sequentially provide a scan signal (i.e., an odd-numbered scan signal and an even-numbered scan signal) to the scan lines in one frame. On the other hand, when the organic light-emitting display device 1060 operates at a second driving frequency, the odd-numbered scan driver may sequentially provide the odd-numbered scan signal to the odd-numbered scan lines in an odd-numbered sub-frame, and the even-numbered scan driver may sequentially provide the even-numbered scan signal to the even-numbered scan lines in an even-numbered sub-frame. Here, when the organic light-emitting display device 1060 operates at the first driving frequency, the emission driver may sequentially provide an emission signal to emission line groups formed by grouping the emission lines by two adjacent emission lines in one frame. On the other hand, the organic light-emitting display device 1060 operates at the second driving frequency, the emission driver may sequentially provide the emission signal to the emission line groups formed by grouping the emission lines by two adjacent emission lines in the odd-numbered sub-frame and the even-numbered sub-frame. The timing controller may control the data driver, the odd-numbered scan driver, the even-numbered scan driver, and the emission driver. Since the organic light-emitting display device 1060 is described above, duplicated description related thereto will not be repeated.

Embodiments according to the present inventive concept may be applied to a display device (e.g., an organic light-emitting display device) and an electronic device including the display device. For example, embodiments according to the present inventive concept may be applied to a smart phone, a cellular phone, a video phone, a smart pad, a smart watch, a tablet PC, a car navigation system, a television, a computer monitor, a laptop, a head mounted display device, an MP3 player, etc.

The foregoing is illustrative of embodiments and is not to be construed as limiting thereof. Although a few example embodiments have been described, those skilled in the art will readily appreciate that many modifications are possible in the embodiments without materially departing from the novel teachings and characteristics of embodiments according to the present inventive concept. Accordingly, all such modifications are intended to be included within the scope of the present inventive concept as defined in the claims. Therefore, it is to be understood that the foregoing is illustrative of various embodiments and is not to be construed as limited to the example embodiments disclosed, and that modifications to the disclosed example embodiments, as well as other embodiments, are intended to be included within the scope of the appended claims and their equivalents.

What is claimed is:

1. An organic light-emitting display device comprising:

a display panel including a plurality of pixels;

a data driver electrically connected to data lines of the display panel and configured to divide one frame into an odd-numbered sub-frame and an even-numbered sub-frame, to divide frame data for implementing the one frame into odd-numbered sub-frame data and even-numbered sub-frame data, to provide the odd-numbered sub-frame data to the data lines in the odd-numbered sub-frame, and to provide the even-numbered sub-frame data to the data lines in the even-numbered sub-frame;

an odd-numbered scan driver electrically connected to odd-numbered scan lines among scan lines of the display panel and configured to provide an odd-numbered scan signal to the odd-numbered scan lines in the odd-numbered sub-frame;

an even-numbered scan driver electrically connected to even-numbered scan lines among the scan lines and configured to provide an even-numbered scan signal to the even-numbered scan lines in the even-numbered sub-frame;

an emission driver electrically connected to emission lines of the display panel and configured to provide an emission signal to emission line groups formed by grouping the emission lines by two adjacent emission lines in the odd-numbered sub-frame and the even-numbered sub-frame; and a timing controller configured to control the data driver, the odd-numbered scan driver, the even-numbered scan driver, and the emission driver, wherein each of the emission line groups includes an odd-numbered emission line and an even-numbered emission line, and the odd-numbered emission line is electrically connected to the even-numbered emission line.

2. The organic light-emitting display device of claim 1, wherein a non-light-emitting operation of target pixels electrically connected to a target emission line group to which the emission signal is applied is simultaneously performed in a deactivation period of the emission signal, and a light-emitting operation of the target pixels is simultaneously performed in an activation period of the emission signal.

3. The organic light-emitting display device of claim 2, wherein the timing controller is configured to adjust a luminance of the display panel by adjusting a ratio between the activation period and the deactivation period of the emission signal.

4. The organic light-emitting display device of claim 2, wherein in the odd-numbered sub-frame, during the deactivation period of the emission signal, a data writing operation of first target pixels electrically connected to the odd-numbered scan line among the target pixels is performed, and a data writing operation of second target pixels electrically connected to the even-numbered scan line among the target pixels is not performed.

5. The organic light-emitting display device of claim 4, wherein in the odd-numbered sub-frame, during the activation period of the emission signal, the first target pixels are configured to emit light based on current odd-numbered sub-frame data, and the second target pixels are configured to emit light based on previous even-numbered sub-frame data.

6. The organic light-emitting display device of claim 2, wherein in the even-numbered sub-frame, during the deactivation period of the emission signal, a data writing operation of first target pixels electrically connected to the odd-numbered scan line among the target pixels is not performed, and a data writing operation of second target pixels electrically connected to the even-numbered scan line among the target pixels is performed.

7. The organic light-emitting display device of claim 6, wherein in the even-numbered sub-frame, during the activation period of the emission signal, the first target pixels are configured to emit light based on previous odd-numbered sub-frame data, and the second target pixels are configured to emit light based on current even-numbered sub-frame data.

8. The organic light-emitting display device of claim 1, wherein the odd-numbered scan driver includes first to (2k−1)th scan stages that are configured to sequentially generate the odd-numbered scan signal, where k is an integer greater than or equal to 1, and wherein the odd-numbered scan driver is configured to sequentially provide the odd-numbered scan signal to the odd-numbered scan lines in response to the timing controller applying an odd-numbered scan start signal to the first scan stage in the odd-numbered sub-frame.

9. The organic light-emitting display device of claim 8, wherein in the even-numbered sub-frame, the timing controller is configured to not apply the odd-numbered scan start signal to the first scan stage, and clock signals applied to the first to (2k−1)th scan stages have a low voltage level.

10. The organic light-emitting display device of claim 8, wherein the even-numbered scan driver includes second to (2k)th scan stages that are configured to sequentially generate the even-numbered scan signal, and wherein the even-numbered scan driver is configured to sequentially provide the even-numbered scan signal to the even-numbered scan lines in response to the timing controller applying an even-numbered scan start signal to the second scan stage in the even-numbered sub-frame.

11. The organic light-emitting display device of claim 10, wherein in the odd-numbered sub-frame, the timing controller is configured to not apply the even-numbered scan start signal to the second scan stage, and clock signals applied to the second to (2k)th scan stages have a low voltage level.

12. The organic light-emitting display device of claim 10, wherein a pulse width of the odd-numbered scan start signal is equal to a pulse width of the odd-numbered scan signal, and a pulse width of the even-numbered scan start signal is equal to a pulse width of the even-numbered scan signal.

13. The organic light-emitting display device of claim 10, wherein a pulse width of the odd-numbered scan start signal is greater than a pulse width of the odd-numbered scan signal, and a pulse width of the even-numbered scan start signal is greater than a pulse width of the even-numbered scan signal.

14. The organic light-emitting display device of claim 1, wherein each of the emission line groups includes an odd-numbered emission line and an even-numbered emission line, and the odd-numbered emission line is not electrically connected to the even-numbered emission line.

15. The organic light-emitting display device of claim 14, wherein the emission driver includes an odd-numbered emission driver configured to sequentially provide the emission signal to the odd-numbered emission lines and an even-numbered emission driver configured to sequentially provide the emission signal to the even-numbered emission lines, and the odd-numbered emission driver and the even-numbered emission driver are configured to simultaneously provide the emission signal to each of the emission line groups.

16. The organic light-emitting display device of claim 15, wherein the odd-numbered emission driver is electrically connected to the odd-numbered emission lines and includes first to (2k−1)th emission stages that are configured to sequentially generate the emission signal, where k is an integer greater than or equal to 1, and wherein the odd-numbered emission driver is configured to sequentially provide the emission signal to the odd-numbered emission lines in response to the timing controller applying an emission start signal to the first emission stage in the odd-numbered sub-frame and the even-numbered sub-frame.

17. The organic light-emitting display device of claim 16, wherein the even-numbered emission driver is electrically connected to the even-numbered emission lines and includes second to (2k)th emission stages configured to sequentially generate the emission signal, and wherein the even-numbered emission driver is configured to sequentially provide the emission signal to the even-numbered emission lines in response to the timing controller applying the emission start signal to the second emission stage in the odd-numbered sub-frame and the even-numbered sub-frame.

18. The organic light-emitting display device of claim 17, wherein the timing controller is configured to simultaneously apply the emission start signal to the first emission stage and the second emission stage in the odd-numbered sub-frame and the even-numbered sub-frame.

19. The organic light-emitting display device of claim 1, wherein the emission driver is electrically connected to the emission line groups and includes first to (k)th emission stages configured to sequentially generate the emission signal, and wherein the emission driver is configured to sequentially provide the emission signal to the emission line groups in response to the timing controller applying an emission start signal to the first emission stage in the odd-numbered sub-frame and the even-numbered sub-frame.

* * * * *